US008471787B2

(12) United States Patent
Ihata et al.

(10) Patent No.: US 8,471,787 B2
(45) Date of Patent: Jun. 25, 2013

(54) DISPLAY METHOD OF EMISSION DISPLAY APPARATUS

(75) Inventors: Junichi Ihata, Kawasaki (JP); Koichi Fukuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1360 days.

(21) Appl. No.: 12/185,347

(22) Filed: Aug. 4, 2008

(65) Prior Publication Data

US 2009/0051627 A1 Feb. 26, 2009

(30) Foreign Application Priority Data

Aug. 24, 2007 (JP) ..... 2007-218370
Jul. 23, 2008 (JP) ..... 2008-189273

(51) Int. Cl.
*G09G 3/30* (2006.01)

(52) U.S. Cl.
USPC ..... 345/76

(58) Field of Classification Search
USPC ..... 345/76
See application file for complete search history.

(56) References Cited

U.S. PATENT DOCUMENTS

| | | | | |
|---|---|---|---|---|
| 6,724,945 | B1 * | 4/2004 | Yen et al. | 382/274 |
| 7,292,024 | B2 * | 11/2007 | Zhang et al. | 348/178 |
| 2003/0210256 | A1 * | 11/2003 | Mori et al. | 345/690 |
| 2005/0179675 | A1 * | 8/2005 | Hekstra et al. | 345/204 |
| 2005/0259886 | A1 * | 11/2005 | Shan | 382/260 |
| 2006/0132653 | A1 * | 6/2006 | Higashi | 348/556 |

FOREIGN PATENT DOCUMENTS

| | | | |
|---|---|---|---|
| EP | 1 601 184 | A1 | 11/2005 |
| GB | 2 364 461 | A | 1/2002 |
| GB | 2 425 674 | A | 1/2006 |
| GB | 2 425 674 | A | 11/2006 |
| JP | 2000-356981 | | 12/2000 |
| JP | 2001-175221 | | 6/2001 |
| WO | 03/100756 | A2 | 4/2003 |
| WO | 03/100756 | A2 | 12/2003 |

OTHER PUBLICATIONS

European Search Report dated Jun. 18, 2010, in related corresponding European Patent Appln. No. 08162229.2.
European Office Action dated Sep. 14, 2011, in related European Patent Application No. 08162229.2.

* cited by examiner

*Primary Examiner* — Amare Mengistu
*Assistant Examiner* — Jennifer Zubajlo
(74) *Attorney, Agent, or Firm* — Fitzpatrick, Cella, Harper & Scinto

(57) ABSTRACT

A display method of an emission display apparatus including a display panel in which a plurality of pixels each having at least one subpixel are disposed, includes a first display method of performing the display of an image input data with only a subpixel using emission luminance, and a second display method of performing the display of the image input data with a nearby subpixel group. A display according to the second display method is performed with the emission luminance distributed to the subpixels of the nearby subpixel group, wherein a display is performed using an intermediate mode in which the first display method and the second display method are combined with a variable combination ratio. In the intermediate mode the emission luminance of the subpixel corresponding to the image input data is reduced in accordance with the combination ratio, and the display of the image input data is performed with the subpixel using the reduced emission luminance and with the nearby subpixel group with the emission luminance corresponding to the reduction distributed to the subpixels of the nearby subpixel group.

1 Claim, 17 Drawing Sheets

ALL PIXELS TURNED ON

TURNED ON FOR 100 HOURS

DISPLAY METHOD OF EMISSION DISPLAY APPARATUS

BACKGROUND OF THE INVENTION

1. Field of the Invention

The present invention relates to a display method of an emission display apparatus using an organic EL device, and more particularly, to a display method of an emission display apparatus which features a control method of a pixel structure.

2. Description of the Related Art

In a flat panel image display apparatus (flat panel display) such as an organic EL display, when the same still image is displayed for a long period of time, a phenomenon called "sticking" occurs. The term "sticking" herein employed means that only a part of a display screen is degraded (reduction of emission luminance) to generate a residual image (after image) which can be visually recognized. The sticking is liable to occur in an edge portion or the like of a still image.

In organic EL displays having a plurality of subpixels of different emission wavelengths, there are many cases where the degradation characteristics are not identical for each emission color. In addition, because the content of an image displayed on the display screen is not uniform, the degradation is liable to proceed locally. In this case, because the reduction in emission luminance differs for each color, there occurs the so-called "color shift" in which the white balance is deviated, whereby a white image appears to be colored.

Further, examples of factors for accelerating the degradation include display of a fixed pattern, nonuniformity of emission times of respective subpixels, time period in which light is emitted, ambient temperature, and magnitude of emission luminance, which are responsible for the sticking phenomenon.

In order to suppress the sticking phenomenon, it is preferred to improve emission lifetimes of constituent materials. However, it is difficult to say that the sticking phenomenon can be sufficiently suppressed only by improving the materials. Documents disclosing technologies for suppressing the sticking phenomenon are described below.

Firstly, there is disclosed a technology of controlling the emission luminance of each color based on an accumulated emission time to ensure uniform progression of degradation of respective colors, thereby obscuring the sticking (Japanese Patent Application Laid-Open No. 2000-356981).

Secondly, there is disclosed a technology of detecting the luminance of a pixel degraded due to high luminance emission and adjusting the luminances of the other pixels to the luminance of the degraded pixel, thereby obscuring the sticking (Japanese Patent Application Laid-Open No. 2001-175221).

However, according to the technology disclosed in Japanese Patent Application Laid-Open No. 2000-356981, the luminance of the entire display screen is merely reduced based on the display time length, and hence occurrence of the "sticking" phenomenon cannot be essentially avoided. Moreover, the technology disclosed in Japanese Patent Application Laid-Open No. 2001-175221 has an effect of suppressing the color shift because the luminance of the other pixels is adjusted to the luminance of the pixel degraded due to high luminance emission. However, there is no effect of suppressing the luminance degraded itself of the pixels. Further, an additional sensor is required for detecting the luminance, thereby resulting in an increase in the production cost and a reduction in resolution.

In an organic EL display, when the same still image is displayed for a long period of time, only a part of a display screen is degraded, thereby causing the sticking phenomenon. Further, in organic EL displays having a plurality of subpixels of different emission wavelengths, since the degradation characteristics are not identical for each emission color, there is caused a color shift in many cases.

SUMMARY OF THE INVENTION

The present invention has been accomplished in view of the problems described above. It is, therefore, an object of the present invention to provide a display method of an emission display apparatus that can suppress the sticking of pixels to improve the life of a display panel.

In order to achieve the above-mentioned object, the present invention includes the following specific features. The present invention provides a display method of an emission display apparatus including a display panel in which a plurality of pixels each having at least one subpixel are disposed. It is assumed that a coordinate in a vertical direction is expressed by "i", and a coordinate in a horizontal direction is expressed by "j". Then, display of image input data $D^a(i,j)$ for a subpixel $Sp^a(i,j)$ which constitutes a pixel P(i,j) located at a position (i,j) and which has a display color "a". In this case, there are two display methods. A first display method performs display of the image input data $D^a(i,j)$ by use of only the subpixel $Sp^a(i,j)$. A second display method performs display of the image input data $D^a(i,j)$ with a nearby subpixel group $Sp^a(i',j')$ which is a group of subpixels each having the display color "a" and included in a nearby pixel group P(i',j') disposed surrounding the pixel P(i,j). In the emission display apparatus according to the present invention, the first display method and the second display method are combined for display control and the combination ratio therebetween is made variable in a controllable manner.

In the display method of an emission display apparatus according to the present invention, a high-resolution mode with a high ratio of the first display method and a long-life mode with a high ratio of the second display method are switched therebetween, so that sticking of pixels can be suppressed to improve the life of a display panel.

Further features of the present invention will become apparent from the following description of exemplary embodiments with reference to the attached drawings.

DESCRIPTION OF THE EMBODIMENTS

Hereinafter, display methods of emission display apparatuses according to exemplary embodiments of the present invention are described with reference to the attached drawings.

Each of the emission display apparatuses to which display methods according to the exemplary embodiments of the present invention are applied includes a display panel in which a plurality of pixels each having at least one subpixel are disposed. It is assumed that a coordinate in the vertical direction is expressed by "i" and a coordinate in the horizontal direction is expressed by "j". Then, display of image input data $D^a(i,j)$ corresponding to a subpixel $Sp^a(i,j)$ which constitutes a pixel P(i,j) located at a position (i,j) and has a display color "a". At this time, there are two display methods. A first display method is to display the image input data $D^a(i,j)$ by using only the subpixel $Sp^a(i,j)$. A second display method is to display the image input data $D^a(i,j)$ by using a nearby subpixel group $Sp^a(i',j')$ which is a group of subpixels, each of which has a display color "a" and is included in a nearby pixel group P(i',j') disposed around the pixel P(i,j). In the emission display apparatus according to the present invention, the first display method and the second display method are combined to perform display control and the combination ratio therebetween is made variable in a controllable manner. Besides, the combination ratio between the first display method and the second display method in the display panel can be controlled so as to be varied for each image input data $D^a(i,j)$.

(First Embodiment)

FIGS. 1 to 15 are schematic diagrams each illustrating a pixel structure of an emission display apparatus used in a first embodiment of the present invention.

Each of the emission display apparatuses as illustrated in FIGS. 1 to 9 shows pixels 11 with an arrangement of three rows by three columns (3×3). Each of the pixels includes R, G, and B subpixels 11*a*, 11*b*, and 11*c*. The coordinate in the vertical direction is expressed by "i" and the coordinate in the horizontal direction is expressed by "j". The display of image input data $D^a(i,j)$ corresponding to a subpixel $Sp^a(i,j)$ which constitutes a pixel P(i,j) located at a position (i,j) and has a display color "a" is performed. The term "subpixel $Sp^a(i,j)$" herein employed refers to, for example, R subpixel, G subpixel, or B subpixel that constitutes the pixel P(i,j). Further, the term "nearby pixel group P(i',j')" herein employed refers to, for example, a group consisting of nearby pixels P(i−1,j), P(i+1,j), P(i,j−1), and P(i,j+1) which surround the pixel P(i,j). Moreover, the term "nearby subpixel group $Sp^a(i',j')$" herein employed refers to a group consisting of R subpixels, G subpixels, or B subpixels, respectively, contained in the nearby pixels P(i−1,j), P(i+1,j), P(i,j−1), and P(i,j+1) constituting the nearby pixel group P(i',j').

Figure 1:
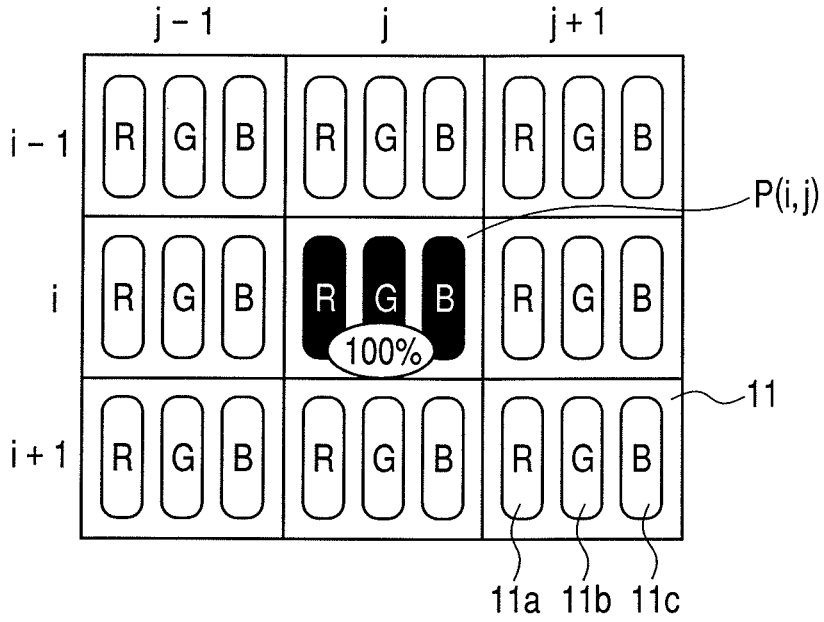
FIG. 1 is a schematic diagram illustrating a pixel structure of an emission display apparatus used in a first embodiment of the present invention

FIG. 1 illustrates a high-resolution display mode in which the image input data $D^a(i,j)$ is displayed by use of only the first display method. In the display mode illustrated in FIG. 1, each subpixel $Sp^a(i,j)$ serving as an emission center emits light at a luminance of 100%, and only each subpixel $Sp^a(i,j)$ serving as the emission center emits light, so that a sharp image whose contour is clear can be displayed. However, there is a fear that the current may concentrate on only the single pixel in a high density, thereby causing sticking due to degradation.

Here, when the emission luminance of a subpixel $Sp^a(i,j)$ is represented by $L^a(i,j)$, the maximum emission luminance thereof is represented by $L^a_{MAX}(i,j)$, and the gradation thereof is represented by $\omega^a(i,j)$ $\{0 \leqq \omega^a(i,j) \leqq 1\}$, the emission luminance $L^a(i,j)$ in a case where only the first display method is used for display can be expressed by Expression (1):

$$L^a(i,j)=\omega^a(i,j)\times L^a_{MAX}(i,j) \tag{1}$$

Figure 5:
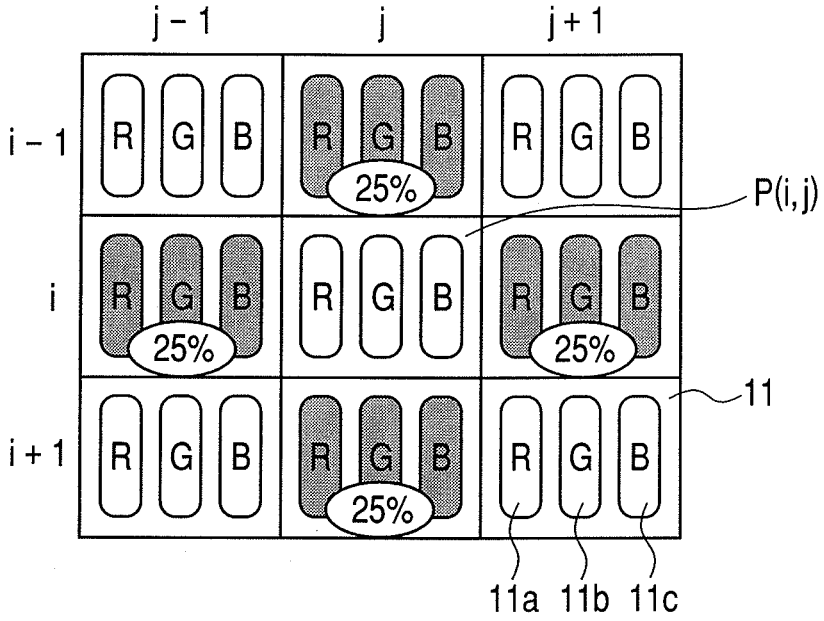
FIG. 5 is a schematic diagram illustrating a pixel structure of the emission display apparatus used in the first embodiment of the present invention.

FIG. 5 illustrates a long-life display mode in which the image input data $D^a(i,j)$ is displayed by use of only the second display method. In the display mode illustrated in FIG. 5, the pixel P(i,j) serving as the emission center does not emit light and each of the nearby pixels P(i−1,j), P(i+1,j), P(i,j−1), and P(i, j+1) that are adjacent thereto emits light at a luminance of 25%.

In this display mode, since the current density applied to the pixel P(i,j) as the emission center is equally distributed to the nearby pixels P(i−1,j), P(i+1,j), P(i,j−1), and P(i,j+1) adjacent thereto, the degradation of the pixel P(i,j) can be reduced. Further, in the display mode illustrated in FIG. 5, since the emission luminance is leveled by the nearby pixels P(i−1,j), P(i+1,j), P(i,j−1), and P(i,j+1) adjacent to the pixel P(i,j), the boundary of an outline becomes smooth, with the result that a change due to luminance degradation is prevented from being easily recognized. That is, the sticking of a display panel can be suppressed through synergy between the effect of reducing the degradation and the effect of smoothing the outline boundary.

Figure 3:
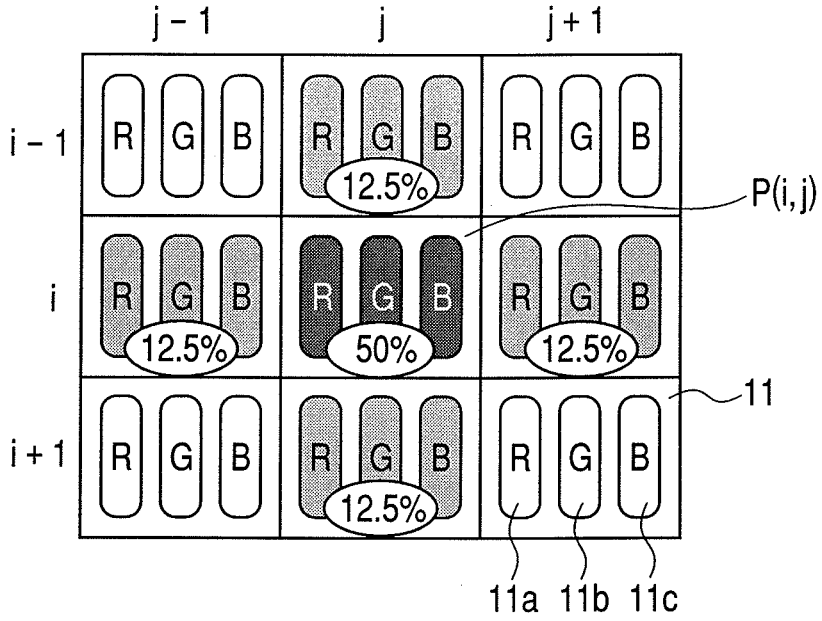
FIG. 3 is a schematic diagram illustrating a pixel structure of the emission display apparatus used in the first embodiment of the present invention.

FIG. 3 illustrates an intermediate mode between the high-resolution mode and the long-life mode in which the image input data $D^a(i,j)$ is displayed by a combination of the first display method and the second display method at a combination ratio of 50%. In the display mode illustrated in FIG. 3, the pixel P(i,j) serving as the emission center emits light at a luminance of 50%, and each of the nearby pixels P(i−1,j), P(i+1,j), P(i,j−1), and P(i,j+1) adjacent thereto emits light at a luminance of 12.5%.

In the display mode illustrated in FIG. 3, the emission luminance of the pixel P(i,j) is reduced to 50% and a luminance corresponding to the reduction therein is equally distributed to the nearby pixels P(i−1,j), P(i+1,j), P(i,j−1), and P(i,j+1) adjacent thereto. Therefore, the sticking is suppressed as compared with the high-resolution mode. However, the sharpness of the image is somewhat reduced.

Figure 2:
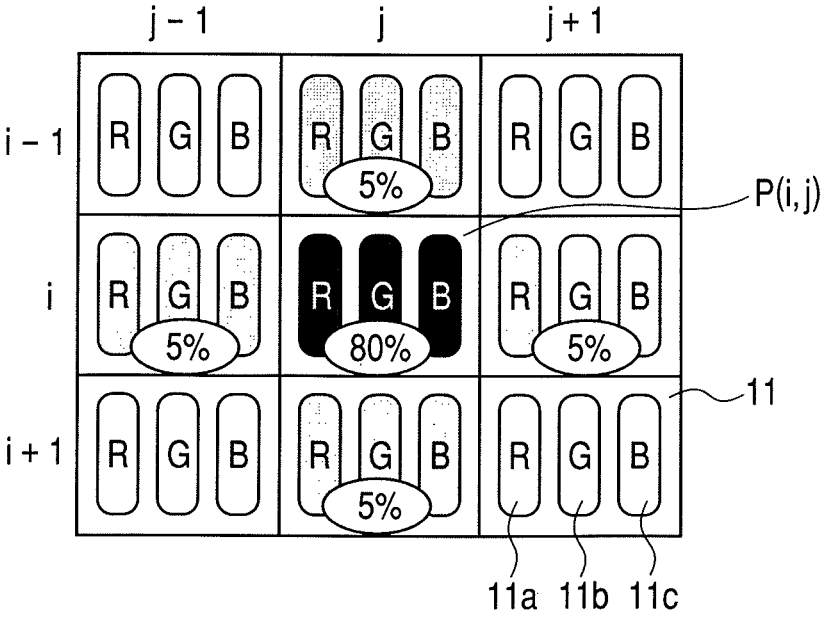
FIG. 2 is a schematic diagram illustrating a pixel structure of the emission display apparatus used in the first embodiment of the present invention.
Figure 4:
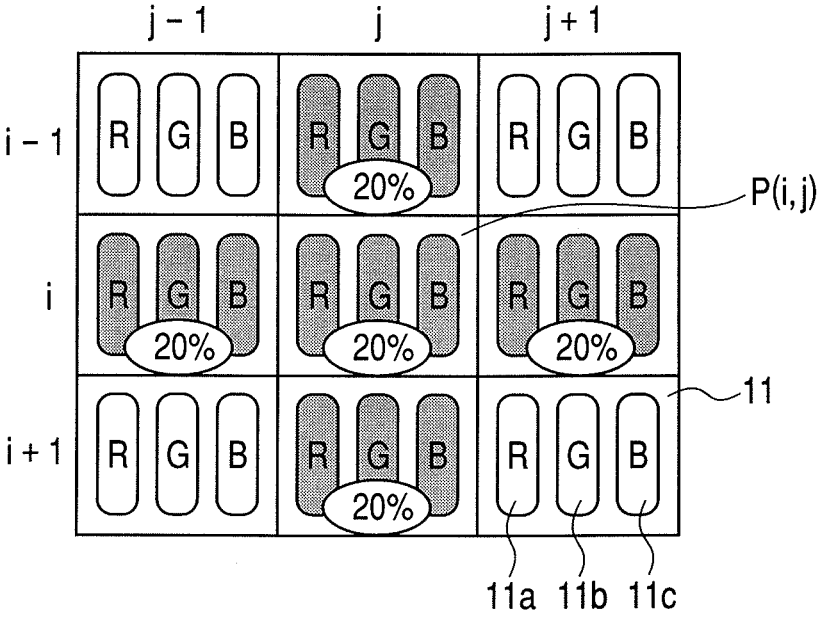
FIG. 4 is a schematic diagram illustrating a pixel structure of the emission display apparatus used in the first embodiment of the present invention.

The combination ratio between the first display method and the second display method in the intermediate mode is not limited to the ratio illustrated in FIG. 3 and can be adjusted depending on the intended use. FIG. 2 illustrates an intermediate mode in which the image input data $D^a(i,j)$ is displayed by a combination of the first display method and the second display method with the ratio of using the first display method being 80%. FIG. 4 illustrates an intermediate mode in which the image input data $D^a(i,j)$ is displayed by a combination of the first display method and the second display method with the ratio of using the first display method being 20%.

The higher the ratio of using the first display method, a sharp image with a clearer outline can be displayed. However, a large current density will be applied to the pixel P(i,j) serving as the emission center, so that sticking is liable to occur. Further, in a case of a low-resolution display panel, it is likely to cause a defect such that oblique lines are displayed to be jagged, or the like. On the contrary, the lower the ratio of using the first display method, longer-life display with a smoother boundary of the outline and less degradation can be performed. However, the entire image is displayed to be somewhat blurred. However, in the case of the low-resolution display panel, there is also an effect of smoothing the contour and improving the resolution.

When the first display method and the second display method are combined for performing display, it is necessary to satisfy the below-mentioned Expressions (2) and (3). Incidentally, α in the expressions indicates a luminance allocation (or distribution) ratio between the pixel P(i,j) and the nearby pixels.

$$L^a(i,j)=\omega^a(i,j)\times\sum_{i',j'}(\alpha^a(i,j:i',j')L^a_{MAX}(i',j')) \tag{2}$$

$$\sum_{i',j'}\alpha^a(i,j:i',j')=1 \tag{3}$$

Figure 6:
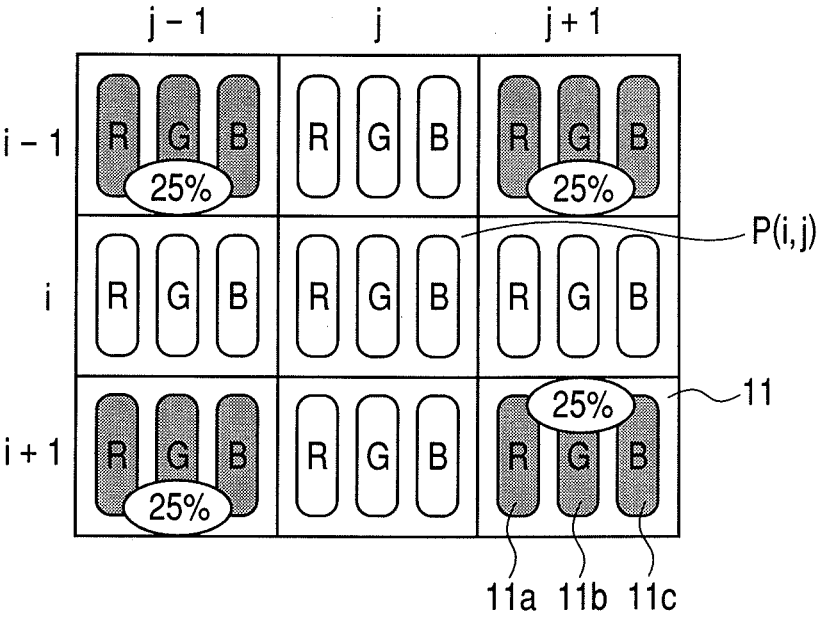
FIG. 6 is a schematic diagram illustrating a pixel structure of the emission display apparatus used in the first embodiment of the present invention.
Figure 7A:
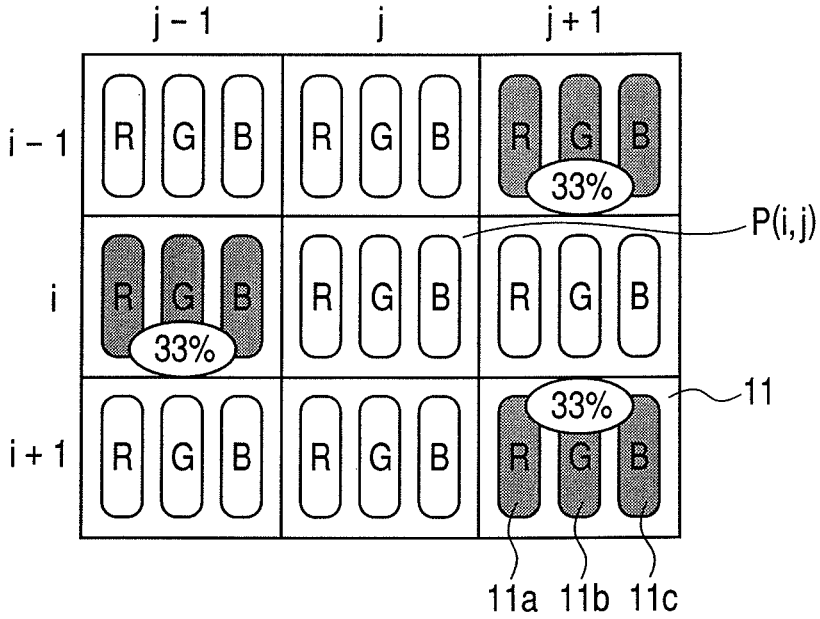
FIGS. 7A and 7B are each a schematic diagram illustrating a pixel structure of the emission display apparatus used in the first embodiment of the present invention.
Figure 7B:
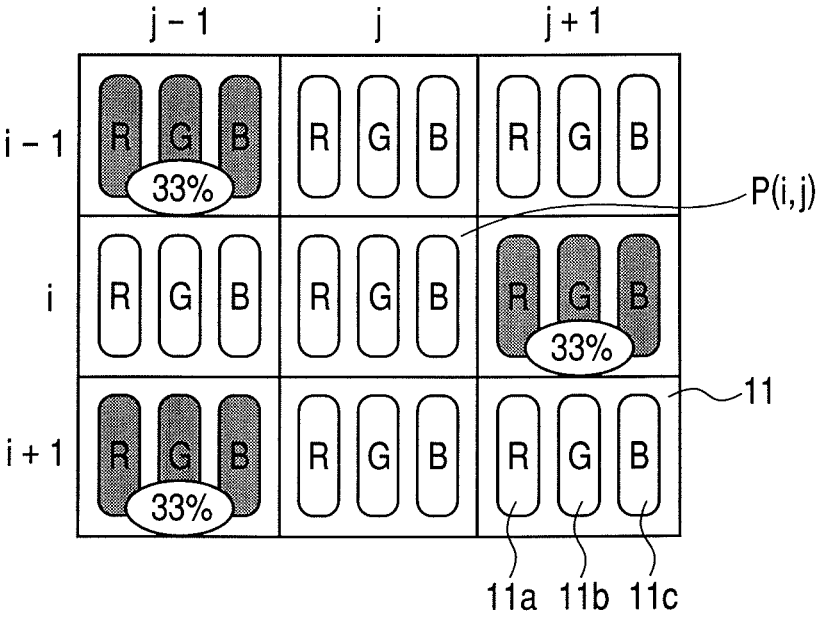
Figure 8A:
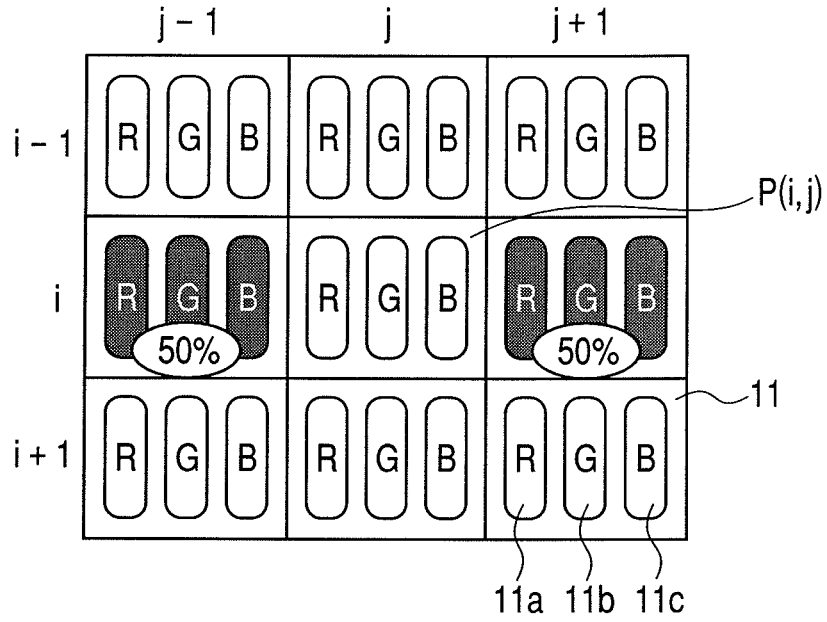
FIGS. 8A and 8B are each a schematic diagram illustrating a pixel structure of the emission display apparatus used in the first embodiment of the present invention.
Figure 8B:
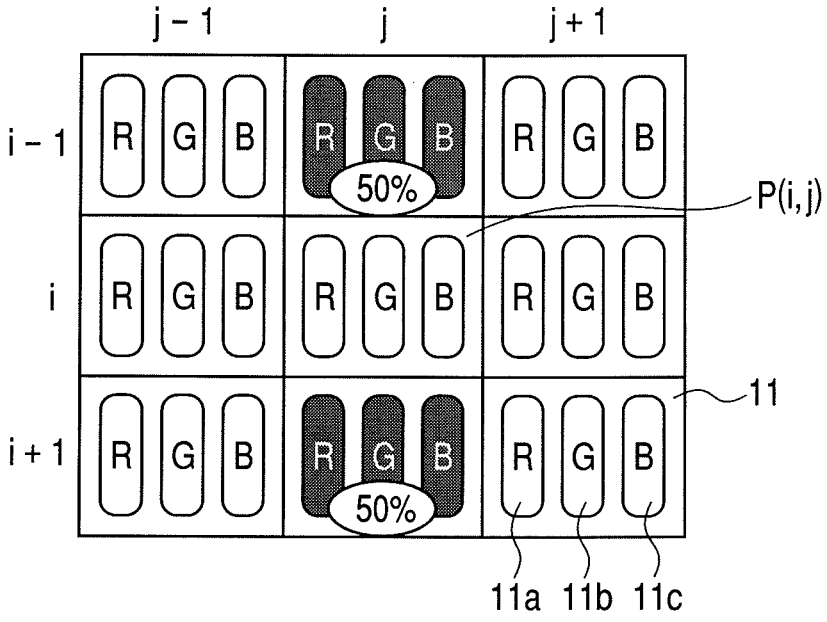
Figure 9:
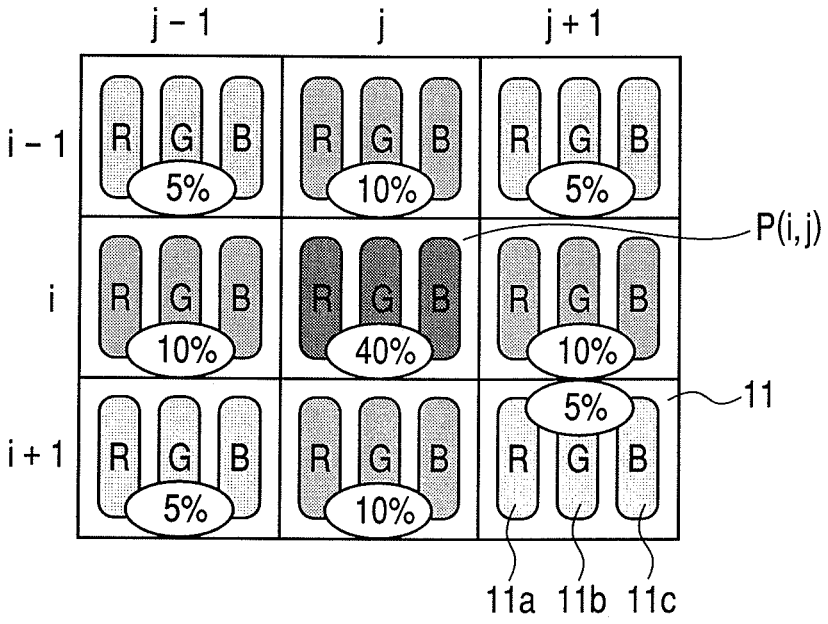
FIG. 9 is a schematic diagram illustrating a pixel structure of the emission display apparatus used in the first embodiment of the present invention.

Moreover, the pixels to which the emission luminance is allocated in the second display method are not limited to the nearby pixels P(i−1,j), P(i+1,j), P(i,j−1), and P(i,j+1). For example, as illustrated in FIG. 6, the emission luminance may be allocated to pixels P(i−1,j−1), P(i+1,j−1), P(i−1,j+1), and P(i+1,j+1) located obliquely to the pixel P(i,j). Further, as long as Expressions (2) and (3) mentioned above are satisfied, the positions and number of pixels to which the emission luminance is allocated in the second display method and the allocation ratio are not limited. For example, as illustrated in FIGS. 7A, 7B, 8A, and 8B, the total number of pixels to which the emission luminance is allocated in the second display method is arbitrary, and as illustrated in FIG. 9, the luminance allocation ratio in the second display method may be varied for each pixel.

Figure 10:
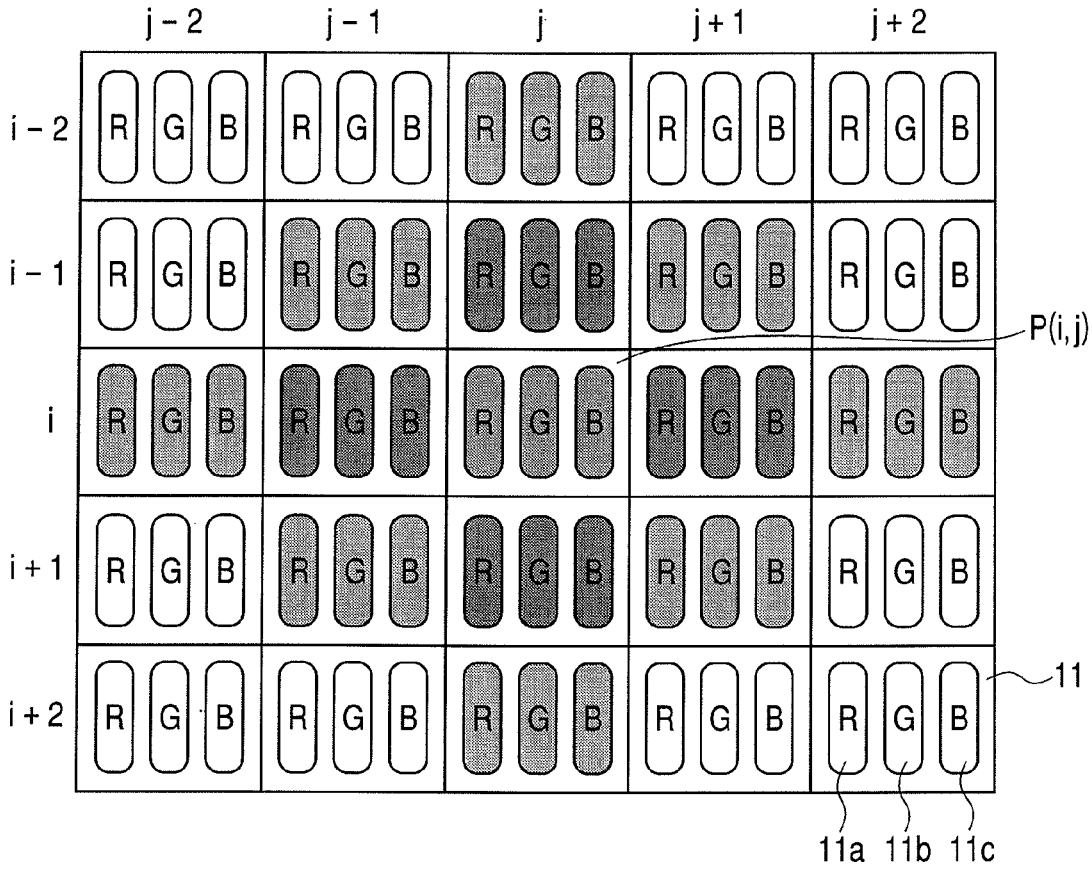
FIG. 10 is a schematic diagram illustrating a pixel structure of the emission display apparatus used in the first embodiment of the present invention.
Figure 11:
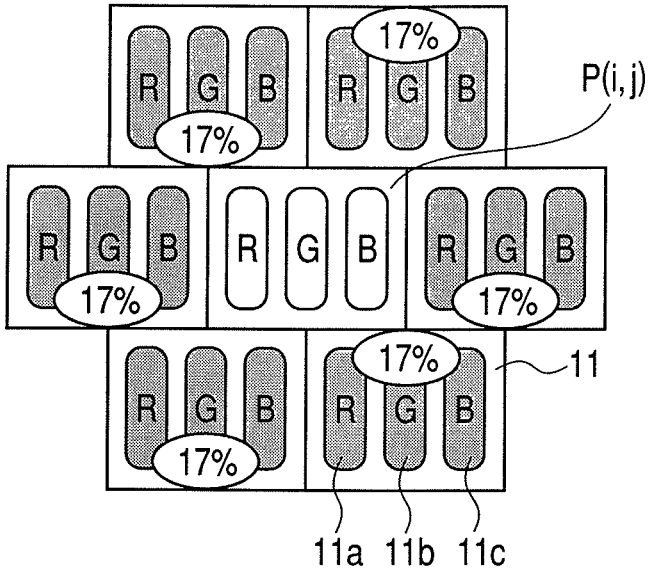
FIG. 11 is a schematic diagram illustrating a pixel structure of the emission display apparatus used in the first embodiment of the present invention.

The pixels to which the emission luminance is allocated in the second display method are not limited to those with the arrangement of three rows by three columns (3×3), and may be those with an arrangement of five rows by five columns (5×5) as illustrated in FIG. 10, or may be those with a delta arrangement as illustrated in FIG. 11.

Figure 12:
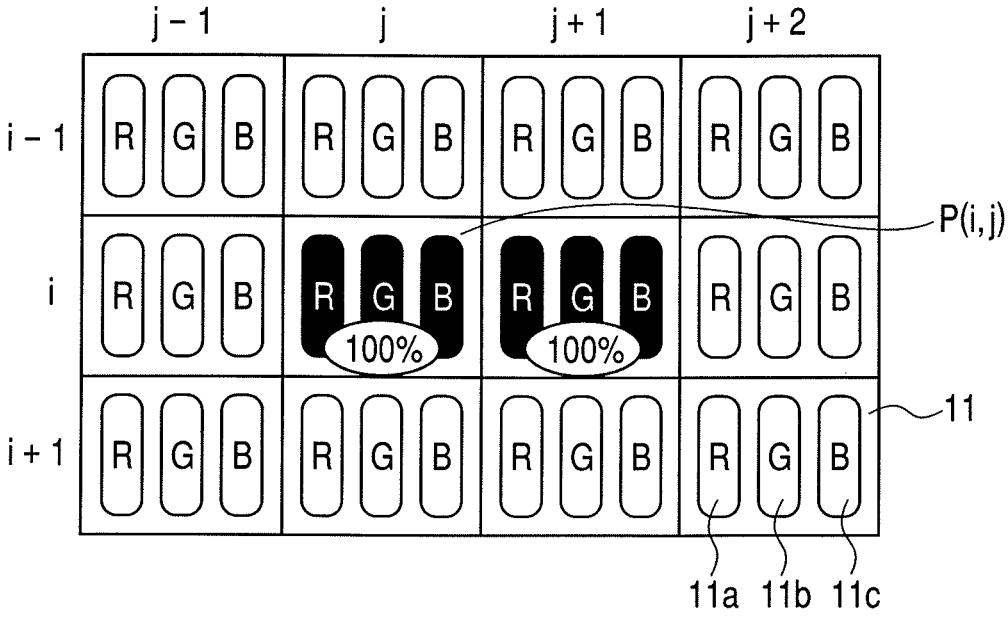
FIG. 12 is a schematic diagram illustrating a pixel structure of the emission display apparatus used in the first embodiment of the present invention.
Figure 13:
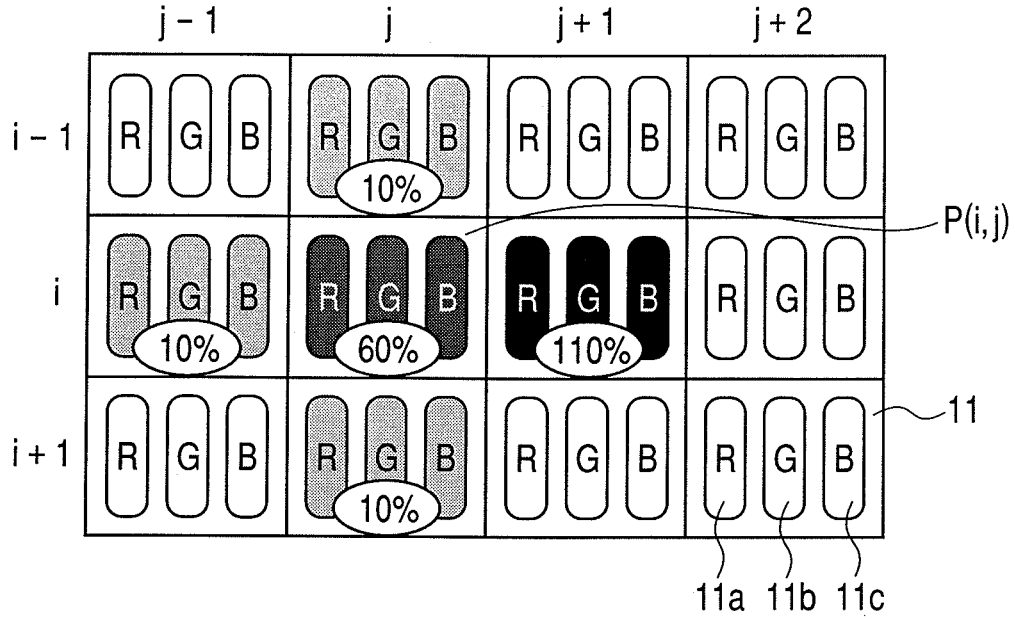
FIG. 13 is a schematic diagram illustrating a pixel structure of the emission display apparatus used in the first embodiment of the present invention.
Figure 14:
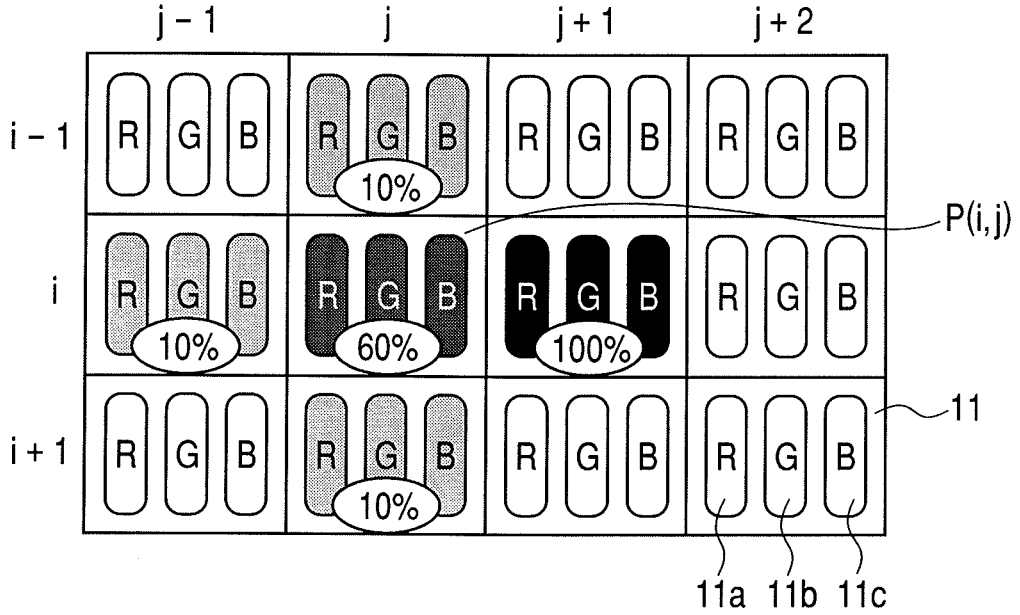
FIG. 14 is a schematic diagram illustrating a pixel structure of the emission display apparatus used in the first embodiment of the present invention.

When the first display method and the second display method are combined for performing display, there may be a case where a pixel is present which is required to emit light at a luminance larger than 100%. For example, FIG. 12 illustrates 3×4 pixels, and each of a pixel located at a position (i,j) and a pixel located at a position (i,j+1) emits light at a luminance of 100%. When the second display method is to be applied to only the pixel located at the position (i,j) at a ratio of 40%, as illustrated in FIG. 13, each of pixels P(i,j−1), P(i−1,j), and P(i+1,j) emits light at a luminance of 10%, and the pixel P(i,j+1) is required to emit light at a luminance of 110%. However, light cannot be emitted from the pixel at a luminance larger than 100%, so that it is necessary to correct the emission luminance. An example of a method of the correction of the emission luminance is, as illustrated in FIG. 14, to allow light emission at a luminance of 100% for all the pixels that are required to emit light at a luminance exceeding 100%. When this method is adopted, the pixel whose luminance is reduced to 100% by the correction performs display at a luminance lower than a normal luminance. In particular, when the ratio of using the second display method is large, there is a demerit that the reduction in the luminance also becomes large.

Figure 15:
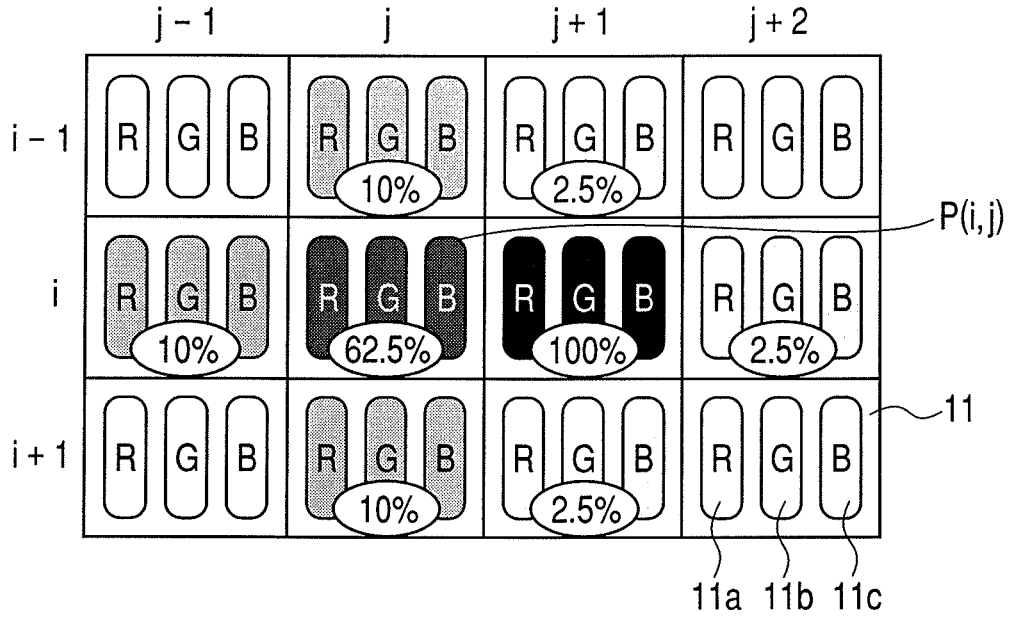
FIG. 15 is a schematic diagram illustrating a pixel structure of the emission display apparatus used in the first embodiment of the present invention.

Another example of the method of the correction of the emission luminance is to distribute an excess luminance above 100% to surrounding pixels. For example, as illustrated in FIG. 13, it is assumed that the second display method is applied at a ratio of 40% to only the pixel located at the position (i,j) of the pixels at the positions (i,j) and (i,j+1) and each emitting light at a luminance of 100%. In this case, each of the pixels P(i,j−1), P(i−1,j), and P(i+1,j) emits light at a luminance of 10% and the pixel P(i,j+1) is required to emit light at a luminance of 110%. Here, the luminance of the pixel P(i,j+1) exceeds 100%, so that a correction is made to distribute the excess luminance of 10% to the surrounding pixels. As illustrated in FIG. 15, 2.5% each of the excess luminance of 10% for the pixel P(i,j+1) is allocated to each of the surrounding pixels. The pixel P(i,j+1) emits light at a luminance of 100%, and each of the pixels P(i−1,j+1), P(i,j+2), and P(i+1,j+1) emits light at a luminance of 2.5%. The pixel P(i,j) emits light at a luminance of 62.5%. When this method is employed, as compared with the above-mentioned correction method of allowing light emission at a luminance of 100% for all the pixels that are required to emit light at a luminance exceeding 100%, a sharper image can be displayed and the reduction in luminance is smaller.

Still another example of the method of the correction of the emission luminance is a method of emitting light at a predetermined low luminance. In this method, the maximum luminance of a display panel is set to a low value in advance. Therefore, even when the luminance is distributed, pixels are prevented from emitting light at a luminance higher than 100%. For example, when there is required a pixel P(i,j+1) that emits light at a luminance of 110% as a result of the luminance distribution as illustrated in FIG. 13, it is necessary to make such a correction that it suffices for the pixel P(i,j+1) to emit light at a luminance of 100%. In other words, by setting an initial luminance to, for example, approximately 90%, even when the luminance distribution is performed, the luminance can be prevented from exceeding 100%. This method can be carried out using the display method according to the present invention. However, there is a problem that the luminance of the display panel itself is reduced.

According to the present invention, by using the high-resolution mode, the long-life mode, or the intermediate mode in a switchable manner depending on the intended use or environments, sticking of a pixel can be reduced to improve the life of the display panel.

For example, it is preferable that with an increase in a spatial change of the image input data $D^a(i,j)$ for the pixel, with a reduction in a time change of the image input data $D^a(i,j)$ for the pixel, or with an increase in an emission time of the image input data $D^a(i,j)$ for the pixel, the ratio of use of the second display method is increased. Further, it is preferred that the combination ratio of the second display method for each of the subpixels is increased with an increase in a degradation rate of the subpixel, and the combination ratio of the first display method for the subpixel is increased with a reduction in the degradation rate of the subpixel. It is also preferred that with a rise in temperature, with an increase in maximum emission luminance, or with an increase in display time, the combination ratio of the second display method is increased.

That is, for a pixel with a larger spatial change of the image input data $D^a(i,j)$, the ratio of the second display method for the corresponding subpixels $Sp^a(i, j)$ is increased. Further, for a pixel with a smaller time change of the image input data $D^a(i,j)$, the ratio of the second display method for the corresponding subpixels $Sp^a(i,j)$ is increased. Moreover, for image input data $D^a(i,j)$ with a longer emission time, the ratio of the second display method is increased. In addition, in a case where each of the pixels includes two or more subpixels, when the degradation rate of one subpixel is higher than the degradation rate of another subpixel, the combination ratio of the second display method is increased, while when the degradation rate of one subpixel is lower than the degradation rate of another subpixel, the combination ratio of the first display method is increased. Furthermore, as for the combination ratio between the first display method and the second display method in at least one subpixel, with a rise in temperature, the combination ratio of the second display method is increased. Moreover, as to the combination ratio between the first display method and the second display method in at least one subpixel, with an increase in maximum emission luminance, the combination ratio of the second display method is increased. In addition, as to the combination ratio between the first display method and the second display method in at least one subpixel, with an increase in display time, the combination ratio of the second display method is increased. Incidentally, the combination ratio between the first display method and the second display method in at least one subpixel is, for example, 1:2.

To be specific, for example, when an image is to be displayed on a high-resolution display panel or when a fast moving image is to be displayed, it is preferred to use the high-resolution mode in which the emission ratio of the emission center pixel is 100%. When a fixed pattern is to be displayed or when high resolution is not so required, it is preferred to use the long-life mode in which respective pixels have distributed emission ratios, thereby suppressing pixel sticking. Further, it is also preferable to use the intermediate mode in normal operation and to switch the display mode depending on the intended use or environments.

By switching the display mode among the high-resolution mode, the long-life mode, and the intermediate mode based not only on an image to be displayed but also on an accumulated emission amount, temperature, or a magnitude of emission luminance, the life of the display panel can be improved. That is, by performing switching among the high-resolution mode, the long-life mode, and the intermediate mode depending on the spatial change and time change of the image input data $D^a(i, j)$, the emission time of a subpixel, the degradation rate, the temperature, the emission luminance, and the display time, the life of the display panel can be improved. Incidentally, the term "accumulated emission amount" herein employed refers to a value obtained by integration with an emission time being taken along x-axis and an emission luminance being taken along y-axis.

In a case where the degradation characteristics of each of the subpixels vary in accordance with the accumulated emission amount, by increasing the ratio of the second display method in a time domain in which the degradation rate is high, the life of the display panel can be improved. For example, the degradation rate generally lowers as the accumulated emission amount increases. Therefore, when the accumulated emission amount is small, the display mode is applied in which the emission ratio of the emission center pixel is low and the emission ratio of the nearby pixels is high. As the accumulated emission amount becomes larger, the display mode is switched to such a mode that the emission ratio of the emission center pixel is high and the emission ratio of the nearby pixels is low. Thus, a high-resolution image can be displayed for a long period of time.

In a case where the degradation characteristics of each of the subpixels vary in accordance with the environmental temperature, when the environmental temperature becomes a temperature at which the degradation rate is high, the ratio of the second display method can be set to a large value, thereby improving the life of the display panel. For example, the degradation rate of a pixel generally increases as the temperature rises. Therefore, it is preferable that when the environmental temperature is low, the display mode is applied in which the emission ratio of the emission center pixel is high and the emission ratio of the nearby pixels is low. When the environmental temperature rises, the display mode is preferably switched to such a mode that the emission ratio of the emission center pixel is low and the emission ratio of the nearby pixels is high.

Further, in a case where the degradation characteristics of each of the subpixels vary in accordance with the magnitude of emission luminance, by increasing the ratio of the second display method for a pixel with an emission luminance at which the degradation rate is high, the life of the display panel can be improved. For example, it is generally considered that when the emission luminance is high, the degradation rate of a pixel is high. Therefore, it is preferable that the display mode in which the emission ratio of the emission center pixel is high and the emission ratio of the nearby pixels is low is applied to image input data whose emission luminance is low. On the other hand, the display mode in which the emission ratio of the emission center pixel is low and the emission ratio of the nearby pixels is high is preferably applied to image input data whose emission luminance is high.

Next, a control method of performing display by controlling the first display method and the second display method are described.

Figure 30:
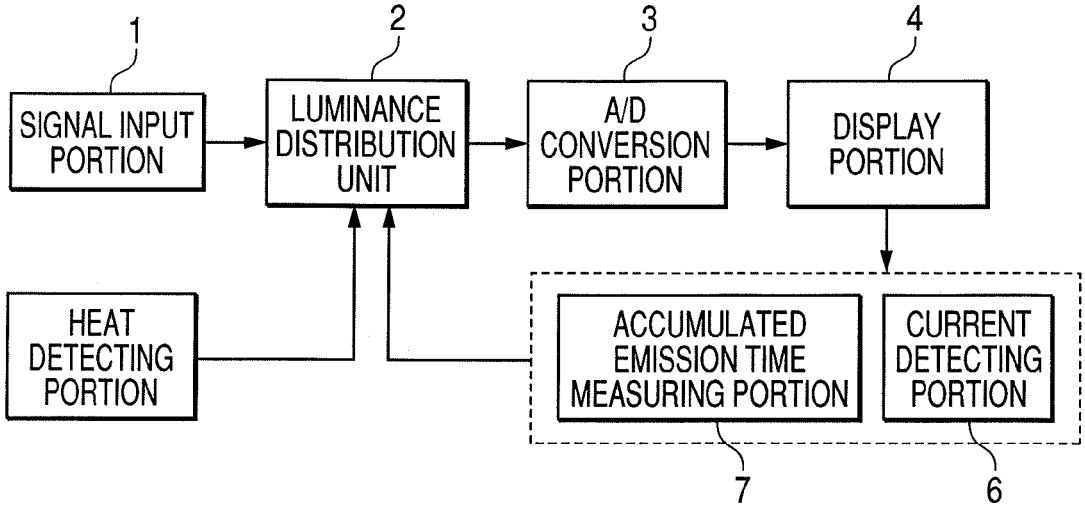
FIG. 30 is a block diagram illustrating a structure of the emission display apparatus used in the embodiment of the present invention.

FIG. 30 is a block diagram illustrating a structure of the emission display apparatus according to an embodiment of the present invention. As illustrated in FIG. 30, the emission display apparatus according to the embodiment of the present invention includes a signal input portion 1, a luminance distribution unit 2, an A/D conversion portion 3, and a display portion 4. The signal input portion 1 receives an image signal. The luminance distribution unit 2 performs luminance distribution processing on the image signal which is input to the signal input portion 1 and outputs the processed image signal to the A/D conversion portion 3. The A/D conversion portion 3 performs A/D conversion on the image signal which is output from the luminance distribution unit 2. The display portion 4 displays an image based on the image signal which is output from the A/D conversion portion 3. The emission display apparatus according to the embodiment of the present invention further includes a heat detecting portion 5 for detecting environmental temperature, a current detecting portion 6 for obtaining an emission luminance of the display portion 4, and an accumulated emission time measuring portion 7 for measuring an accumulated emission time.

The luminance distribution unit 2 is a conversion portion for adjusting the ratio between the first display method and the second display method and desirably selects one mode from among the high-resolution mode, the long-life mode, and the intermediate mode depending on the intended use or environments.

The heat detecting portion 5 is a sensor for sensing temperature and used to measure the temperature of the emission display apparatus. When the temperature of the emission display apparatus reaches the temperature at which the degradation rate is high, the ratio of the second display method is increased, so that sticking can be suppressed.

The current detecting portion 6 is used to measure a current consumed by the emission display apparatus. By increasing the ratio of the second display method for a pixel portion which emits light at high luminance, sticking can be suppressed. The accumulated emission time measuring portion 7 measures the accumulated emission time. By applying the second display method to a portion in which the pixel is significantly degraded, sticking can be suppressed.

(Second Embodiment)

Figure 16:
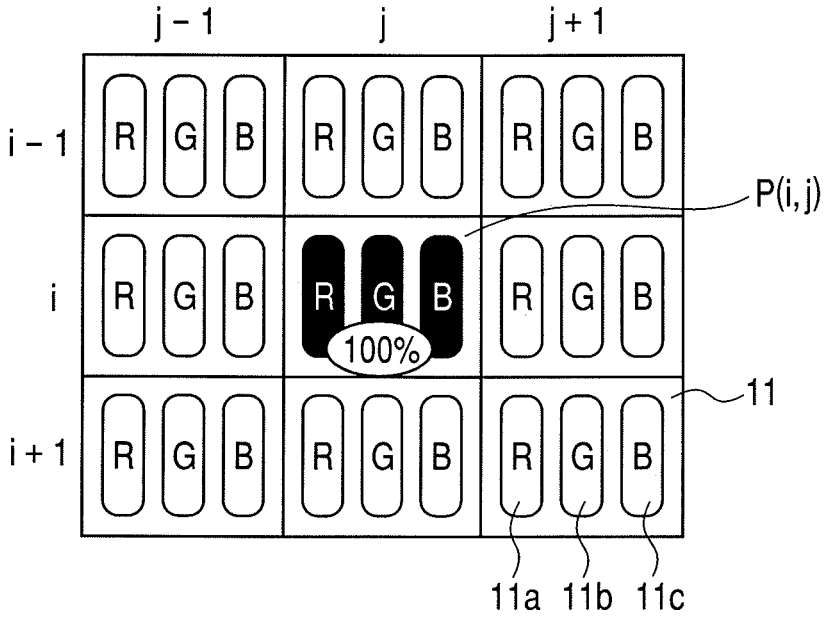
FIG. 16 is a schematic diagram illustrating a pixel structure of an emission display apparatus used in a second embodiment of the present invention.
Figure 17:
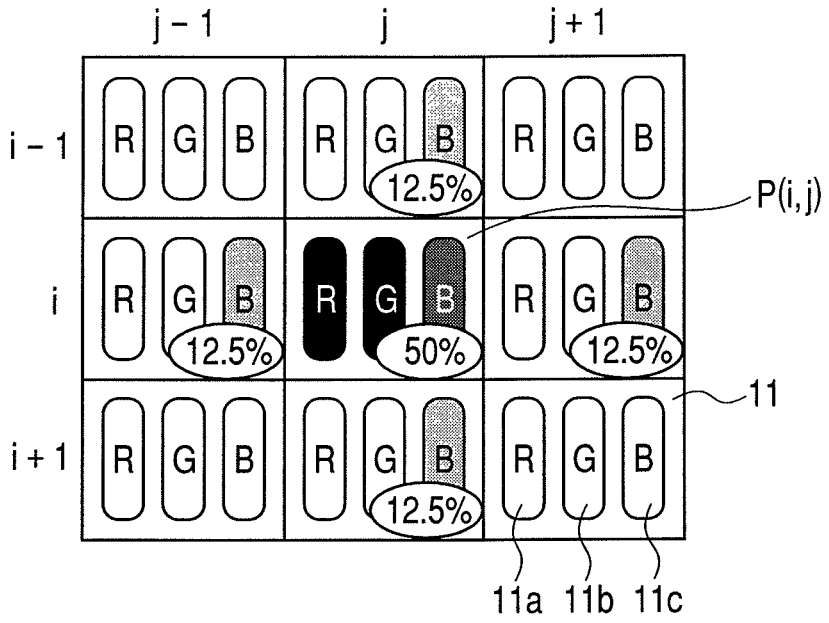
FIG. 17 is a schematic diagram illustrating a pixel structure of the emission display apparatus used in the second embodiment of the present invention.
Figure 18:
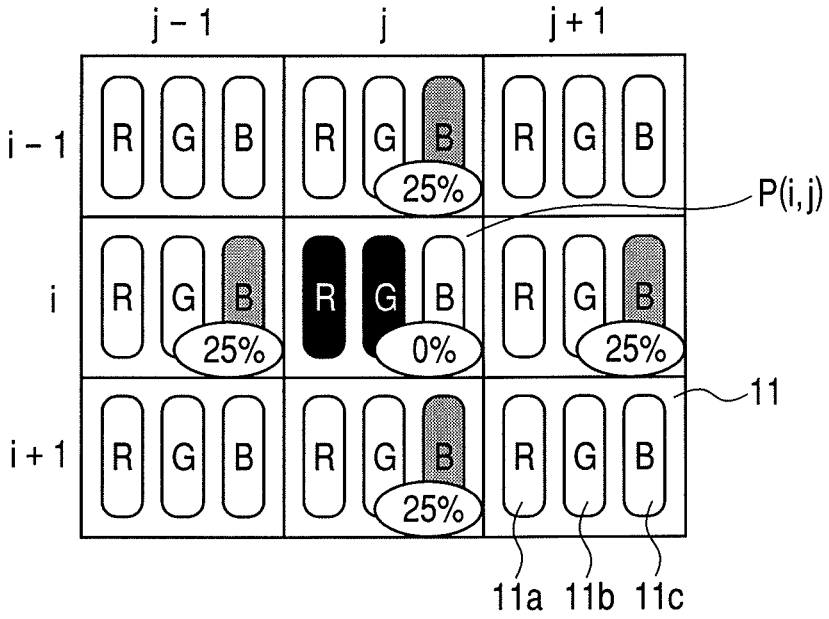
FIG. 18 is a schematic diagram illustrating a pixel structure of the emission display apparatus used in the second embodiment of the present invention.

Next, an emission display apparatus used in a second embodiment of the present invention is described. FIGS. 16 to 18 are schematic diagrams illustrating pixel structures of the emission display apparatus used in the second embodiment of the present invention.

FIG. 16 illustrates a pixel structure in the high-resolution display mode in which the image input data $D^a(i,j)$ is displayed by only the first display method. The pixel structure has the 3×3 pixels 11. Each of the pixels 11 includes the R, G, and B subpixels 11*a*, 11*b*, and 11*c*, respectively. The coordinate in the vertical direction is expressed by "i" and the coordinate in the horizontal direction is expressed by "j". Display of image input data $D^a(i,j)$ with respect to a subpixel $Sp^a(i,j)$ which constitutes a pixel P(i,j) located at a position (i,j) and has a display color "a" is performed.

In the case where the degradation characteristics of a plurality of subpixels having different emission wavelengths are not identical to one another, when R, G, and B subpixels included in a pixel are allowed to emit light at a constant luminance, a subpixel whose degradation rate is high and another subpixel whose degradation rate is low will come to differ in emission luminance from each other, so that a color shift occurs. According to this embodiment, by adjusting the combination ratio between the first display method and the second display method for each of the subpixels of the emission center pixel and the nearby pixels. Therefore, the color shift of a display panel due to degradation can be suppressed.

In the high-resolution display mode illustrated in FIG. 16, subpixels $Sp^a(i,j)$ as the R, G, and B subpixels included in the pixel P(i,j) as the emission center evenly emit light at a luminance of 100%, so that a sharp image whose contour is clear can be displayed. However, when the degradation characteristics differ for each of the R, G, and B colors, a color shift due to luminance degradation will occur because the three-color subpixels are allowed to emit light at a luminance of 100%, respectively.

When it is assumed that the emission luminance for the display color "a" of the pixel P(i,j) is represented by $L^a(i,j)$, the maximum emission luminance thereof is represented by $L^a_{MAX}(i,j)$, and the gradation thereof is represented by $\omega^a(i,j)$, the emission luminance $L^a(i,j)$ in the case where only the first display method is used for display can be expressed by Expressions (4), (5), and (6) below.

$$L^r(i,j)=\omega^r(i,j)\times L^r_{MAX}(i,j) \quad (4)$$

$$L^g(i,j)=\omega^g(i,j)\times L^g_{MAX}(i,j) \quad (5)$$

$$L^b(i,j)=\omega^b(i,j)\times L^b_{MAX}(i,j) \quad (6)$$

FIG. 18 illustrates a pixel structure in the long-life display mode in which the image input data $D^a(i,j)$ is displayed with the second display method being used for only the B subpixels. As illustrated in FIG. 18, each of the R and G subpixels $Sp^r(i,j)$ and $Sp^g(i,j)$ included in the pixel P(i,j) as the emission center emits light at a luminance of 100% and the B subpixel $Sp^b(i,j)$ included therein does not emit light. Instead, each of subpixels $Sp^b(i-1,j)$, $Sp^b(i+1,j)$, $Sp^b(i,j-1)$, and $Sp^b(i,j+1)$ which are, respectively, included in the nearby pixels P(i−1,j), P(i+1,j), P(i,j−1), and P(i,j+1) adjacent to the pixel P(i,j) emits light at a luminance of 25%. For only the B subpixel, the emission luminance is distributed to the nearby pixels. Therefore, the current density applied to the B subpixel $Sp^b(i,j)$ can be leveled, thereby suppressing degradation. This display mode is effective in a case where the degradation rate of the B subpixel is particularly higher than the degradation rates of the other R and G subpixels. By making the degradation rate of the B subpixel close to the degradation rates of the other R and G subpixels, an effect of suppressing the color shift due to sticking can be obtained.

FIG. 17 illustrates a pixel structure in the intermediate mode in which the image input data $D^a(i,j)$ is displayed with the first display method and the second display method being used at a combination ratio of 50% for only the B subpixel. As illustrated in FIG. 17, each of the R and G subpixels $Sp^r(i,j)$ and $Sp^g(i,j)$ included in the pixel P(i,j) as the emission center emits light at a luminance of 100% and only the B subpixel $Sp^b(i,j)$ included therein emits light at a luminance of 50%. Instead, each of the B subpixels $Sp^b(i-1,j)$, $Sp^b(i+1,j)$, $Sp^b(i,j-1)$, and $Sp^b(i,j+1)$ which are, respectively, included in the nearby pixels P(i−1,j), P(i+1,j), P(i,j−1), and P(i,j+1) adjacent to the pixel P(i,j) emits light at a luminance of 12.5%. The emission luminance of the B subpixel $Sp^b(i,j)$ is reduced to 50% and a reduced luminance therein is equally distributed to the nearby subpixels $Sp^b(i-1,j)$, $Sp^b(i+1,j)$, $Sp^b(i,j-1)$, and $Sp^b(i,j+1)$ adjacent thereto. Therefore, the sticking is suppressed as compared with the high-resolution mode. However, the sharpness of the image reduces. The display mode is effective in the case where the degradation rate of the B subpixel is higher than the degradation rates of the other R and G subpixels. By making the degradation rate of the B subpixel close to the degradation rates of the other R and G subpixels, the color shift due to sticking can be suppressed.

When the first display method and the second display method are combined for display on the subpixel having the display color "a", the emission luminance $L^a(i,j)$ needs to satisfy the below-mentioned Expressions (7), (8), (9), (10), (11), and (12) described below. Here, the emission luminance for the display color "a" of the pixel P(i,j) is represented by $L^a(i,j)$, the maximum emission luminance thereof is represented by $L^a_{MAX}(i,j)$, the gradation thereof is represented by $\omega^a(i,j)$, and $\alpha^a(i,j)$ represents the luminance allocation ratio between the pixel P(i,j) and the nearby pixels.

$$L^r(i,j) = \omega^r(i,j) \times \sum_{i',j'} (\alpha^r(i,j:i',j') \times L^r_{MAX}(i',j')) \tag{7}$$

$$L^g(i,j) = \omega^g(i,j) \times \sum_{i',j'} (\alpha^g(i,j:i',j') \times L^g_{MAX}(i',j')) \tag{8}$$

$$L^b(i,j) = \omega^b(i,j) \times \sum_{i',j'} (\alpha^b(i,j:i',j') \times L^b_{MAX}(i',j')) \tag{9}$$

$$\sum_{i',j'} \alpha^r(i,j:i',j') = 1 \tag{10}$$

$$\sum_{i',j'} \alpha^g(i,j:i',j') = 1 \tag{11}$$

$$\sum_{i',j'} \alpha^b(i,j:i',j') = 1 \tag{12}$$

The lower the emission ratio of the subpixels $Sp^r(i,j)$, $Sp^g(i,j)$, and $Sp^b(i,j)$ included in the pixel P(i,j) as the emission center, the more the current density is dispersed to suppress the luminance degradation. However, it is necessary to adjust the emission ratio depending on the degradation characteristics of R, G, and B to prevent the white balance from shifting.

The combination ratio between the first display method and the second display method in the intermediate mode is not limited to the value illustrated in FIG. 18 and a suitable ratio is preferably selected depending on the degradation characteristics of the subpixels for the respective colors or on environmental conditions.

For example, when a fixed pattern is to be displayed, it is preferred to increase the ratio of the second display method in which the emission luminance of a subpixel with a high degradation rate is dispersed. Further, when a color between the display colors of R, G, and B and a white color (hereinafter, referred to as "moderate color") is to be displayed, the influence of color shift due to the degradation of subpixels is noticeable. Therefore, when a moderate color is to be displayed, it is preferred to increase the ratio of second display method.

Further, the second display method is not limited to only subpixels of a single color and may also be applied to subpixels of two or more colors. For example, when the degradation rate increases in the display color order of R, G, and B (highest), the second display method may be applied to the display color B, the intermediate mode between the first display method and the second display method may be applied to the display color G, and the first display method may be applied to the display color R, thereby making the degradation rates for the respective colors consistent with one another to suppress the color shift.

The life of the display panel can be improved not only by varying the combination ratio between the first display method and the second display method depending on an image to be displayed but also by switching the display mode based an accumulated emission amount, temperature, and a magnitude of an emission luminance.

In a case where the degradation characteristics of each of the subpixels vary in accordance with the accumulated emission amount, by increasing the ratio of the second display method in a time domain in which the degradation rate is high, the color shift can be suppressed. For example, when the accumulated emission amount is small, the subpixel of the color B is higher in degradation rate than the subpixels of the other colors. When the accumulated emission amount is large, the subpixel of the color R is higher in degradation rate than the subpixels of the other colors. Therefore, in order to suppress the color shift of the device, when the accumulated emission amount is small, a display mode in which the ratio of the second display method is high is applied to the subpixel B. As the accumulated emission amount increases, the ratio of the second display method for the subpixel R can be increased, thereby suppressing the color shift due to luminance degradation.

When the degradation characteristics of each of the subpixels vary in accordance with environmental temperature, by increasing the ratio of the second display method for a subpixel whose degradation rate is high due to environmental temperature, the color shift due to luminance degradation can be suppressed. For example, a case is assumed where the subpixel of the color R is higher in degradation rate than the subpixels of the other colors in a high-temperature environment and the subpixel of the color of B is higher in degradation rate than the subpixels of the other colors in a low-temperature environment. In this case, a display mode in which the ratio of the second display method is high in the subpixel R is used in the high-temperature environment, and a display mode in which the ratio of the second display method is high in the subpixel B is used in the low-temperature environment, whereby the color shift due to luminance degradation can be suppressed.

When the degradation characteristics of each of the subpixels vary in accordance with the magnitude of emission luminance, by increasing the ratio of the second display method for a subpixel whose degradation rate is increased due to a high magnitude of emission luminance, the color shift due to luminance degradation can be suppressed. For example, a case is assumed where the degradation rate of the subpixel of the color R is high in high-luminance emission and the degradation rate of the subpixel of the color B is high in low-luminance emission. In this case, a display mode in which the ratio of the second display method is high is used in the subpixel R at the time of high luminance emission, and a display mode in which the ratio of the second display method is high is used in the subpixel B at the time of low luminance emission, whereby the color shift due to luminance degradation can be suppressed.

According to the display method of the present invention, by applying the high-resolution mode, the long-life mode, or the intermediate mode to each subpixel independently, the color shift due to the degradation characteristics relating to the respective colors of R, G, and B is suppressed. For example, in a case where the subpixel of the color B is significantly higher in degradation rate than the subpixels of the colors R and G, by applying the long-life mode to only the B subpixel, and by applying the ordinary high-resolution mode to the subpixels of the colors R and G, a long-life display panel free from color shift can be realized.

(Specific Examples in which Present Display Method is Applied to Actual Apparatuses)

Next, specific examples in which the display methods of an emission display apparatus according to the embodiments of the present invention are applied to actual apparatuses are described. FIGS. 19 to 22 are luminance degradation graphs in a case where the display methods of an emission display apparatus according to the embodiments of the present invention are applied to actual apparatuses.

Figure 19:
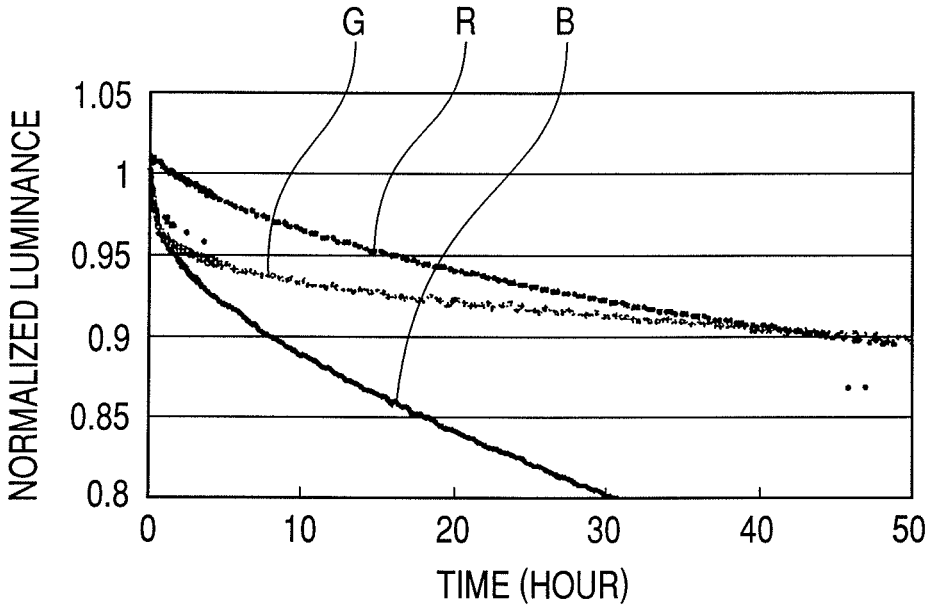
FIG. 19 is a luminance degradation graph in a case where the emission display apparatus used in the embodiment of the present invention is applied to an actual device.

FIG. 19 is an explanatory graph illustrating normalized degradation time data for each color which is represented in terms of the time dependency of a normalized luminance in a case where subpixels of R, G, and B are turned on to display a white color. As illustrated in FIG. 19, when it is presumed that when a difference in luminance between adjacent pixels exceeds 10%, sticking will be caused, the sticking will be recognized after the passage of 45 hours for the color R, 28 hours for the color G, and 5 hours for the color B. When all the subpixels are turned on by only the first display method, the subpixel B causes sticking after the passage of 5 hours later and the subpixel G causes sticking after the passage of 28 hours later, so that a color shift occurs in a display panel. In this case, the life of the display panel is 5 hours in the time period of which the sticking is recognized in the subpixel B.

Therefore, a display mode in which the first display method and the second display method are combined is used and adjusted such that the degradation rates of the subpixels of the respective colors are consistent with each other.

In a calculation used for the adjustment, as a degradation model, a model was applied which is based on the assumption that a device breakdown due to a current flow proceeds at a rate proportional to a value larger than a measured current value (i.e., a value which is 1.5th power of the measured current value). Expression (13) below represents an experimental model in which the device degradation depends on the 1.5th power of the current density. In the expression, $\tau_1$ and $\tau_2$ each represents a degradation time, $I_1$ and $I_2$ each represents a current density, and $L_1$ and $L_2$ each represents an emission luminance. Further, although it is assumed that the current density and the emission luminance are substantially proportional to each other, it is preferred to obtain the current density from the I-L characteristics.

$$\frac{\tau_2}{\tau_1} = \left(\frac{I_1}{I_2}\right)^{1.5} \approx \left(\frac{L_1}{L_2}\right)^{1.5} \tag{13}$$

Figure 23:
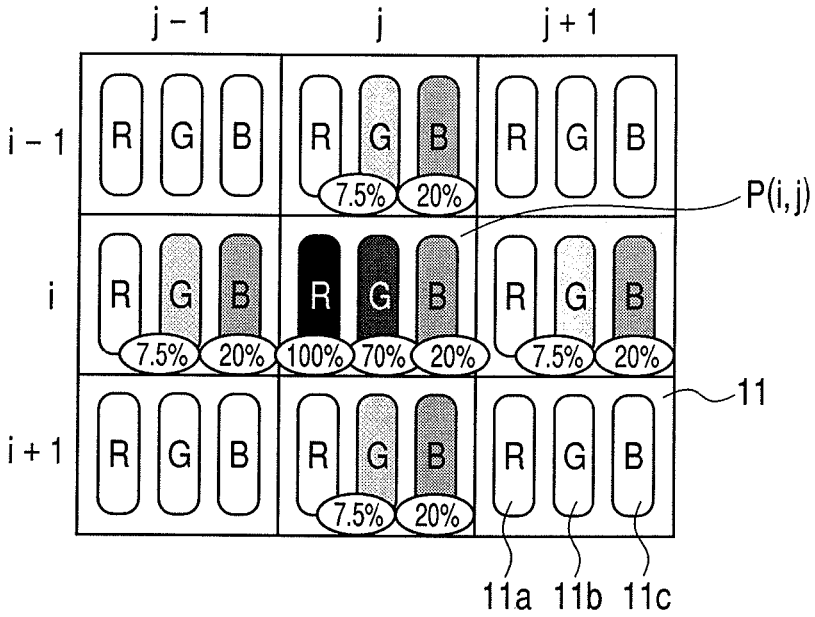
FIG. 23 is a schematic diagram illustrating a pixel structure in a case where the display method of an emission display apparatus according to the embodiment of the present invention is applied to an actual apparatus.

FIG. 23 illustrates a pixel structure in a case where a display method of an emission display apparatus according to an embodiment of the present invention is applied to an actual apparatus. In the example illustrated in FIG. 23, the R subpixel $Sp^r(i,j)$ included in the pixel P(i,j) as an emission center is allowed to emit light by the first display method. Further, the G subpixel $Sp^g(i,j)$ is allowed to emit light with the ratio of the first display method being 70% and the ratio of the second display method being 30%. Moreover, the B subpixel $Sp^b(i,j)$ is allowed to emit light with the ratio of the first display method being 20% and the ratio of the second display method being 80%. That is, in the example illustrated in FIG. 23, the R subpixel $Sp^r(i,j)$ included in the pixel P(i,j) emits light at a luminance of 100%, the G subpixel $Sp^g(i,j)$ emits light at a luminance of 70%, and the B subpixel $Sp^b(i,j)$ emits light at a luminance of 20%. Each of the G subpixels $Sp^g(i-1,j)$, $Sp^g(i+1,j)$, $Sp^g(i, j-1)$, and $Sp^g(i,j+1)$ included, respectively, in the nearby pixels P(i−1,j), P(i+1,j), P(i,j−1), and P(i,j+1) adjacent to the pixel P(i,j) emits light at a luminance of 7.5%. Further, each of the B subpixels $Sp^b(i-1,j)$, $Sp^b(i+1,i)$, $Sp^b(i,j-1)$, and $Sp^b(i,j+1)$ emits light at a luminance of 20%. The emission luminance of each of the B and G subpixels included in the pixel P(i, j) as the emission center is distributed to the surrounding nearby pixels, thereby suppressing degradation. The degradation of the B subpixel whose luminance distribution degree is high is further suppressed.

Figure 20:
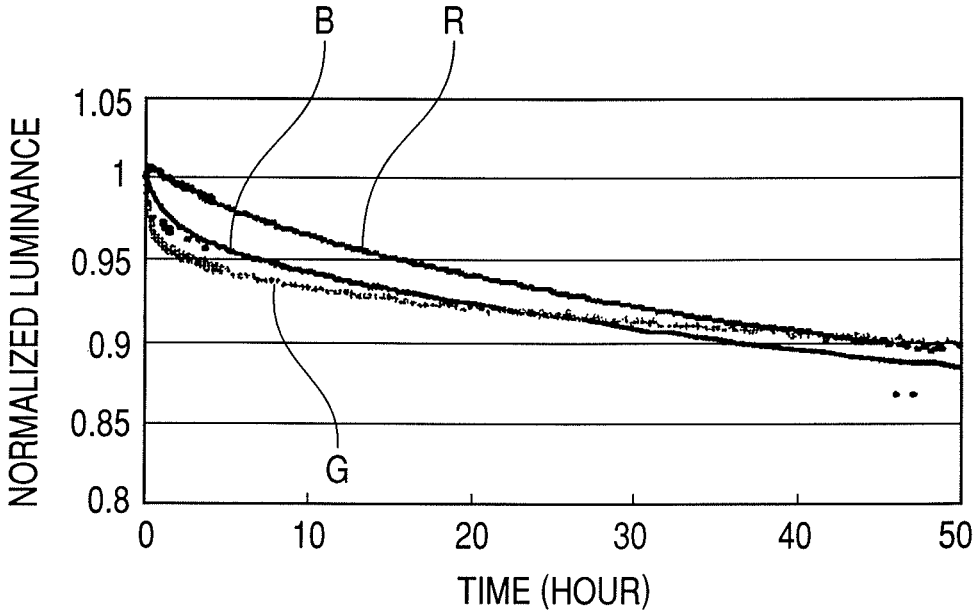
FIG. 20 is a luminance degradation graph in a case where the display method of an emission display apparatus according to the embodiment of the present invention is applied to an actual apparatus.

FIG. 20 is a luminance degradation graph for each color which is represented in terms of the time dependency of a normalized luminance in a case where the second display method is incorporated into the subpixel G at a ratio of 30% and the second display method is incorporated into the subpixel B at a ratio of 80%. When a white color is displayed by using such a display method, the subpixel R causes sticking 48 hours later, the subpixel G causes sticking 47 hours later, and the subpixel B causes sticking 50 hours later. In this display mode, all of the subpixels R, G, and B have substantially the same degradation time, so that display can be performed while hardly causing color shift due to luminance degradation.

Figure 21:
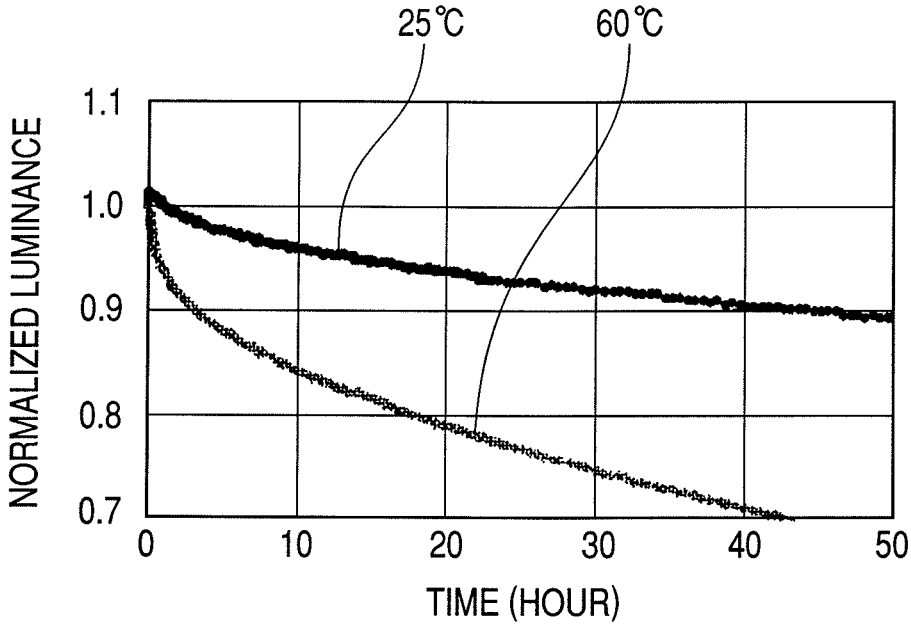
FIG. 21 is a luminance degradation graph in a case where the display method of an emission display apparatus according to the embodiment of the present invention is applied to an actual apparatus.

FIG. 21 illustrates normalized degradation time data for each color which is represented in terms of the time dependency of a normalized luminance in a case where a white color is displayed in each of an environment of 25° C. and an environment of 60° C. When it is presumed that when a difference in luminance between adjacent pixels exceeds 10%, sticking will be caused, the sticking will be recognized after the passage of 42 hours in the environment of 25° C., and after the passage of 3 hours in the environment of 60° C.

Therefore, a display mode in which the first display method and the second display method are combined is used to make an adjustment such that the degradation is suppressed in the environment of 60° C. in which the degradation rate is high.

Figure 22:
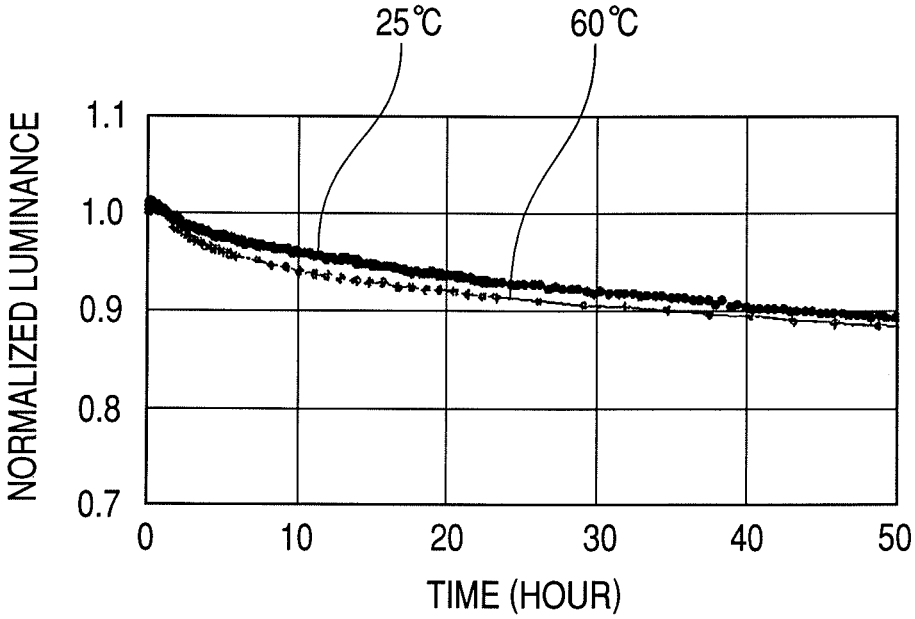
FIG. 22 is a luminance degradation graph in a case where the display method of an emission display apparatus according to the embodiment of the present invention is applied to an actual apparatus.

FIG. 22 is a luminance degradation graph for each color which is represented in terms of the time dependency of a normalized luminance in a case where the second display method is incorporated at a ratio of 80% in the environment of 60° C. This is a display mode in which the pixel as the emission center emits light at a luminance of 20% and the remaining luminance of 80% is distributed (or allocated) to nearby pixels surrounding the emission center pixel. When a white color is displayed by using such a display method, the time until occurrence of sticking in the environment of 60° C. is prolonged to 40 hours. Therefore, in a case where the environmental temperature is high, by applying a display mode in which the incorporation ratio of the second display method is high, the life of the display panel can be extended.

Specific Effect of Present Invention

Next, the effect of the display method of an emission display apparatus according to the embodiment of the present invention is described in detail.

FIGS. 24 to 29 illustrate pixel structures to specifically describe the effect of the display method of an emission display apparatus according to the embodiments of the present invention.

Figure 24:
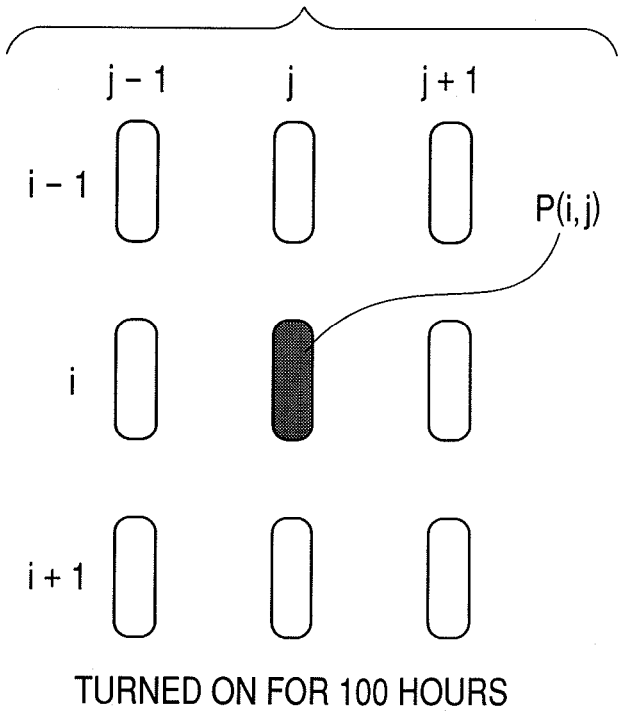
FIG. 24 is a schematic diagram illustrating a pixel structure to specifically explain the effect of the display method of an emission display apparatus according to the embodiment of the present invention.
Figure 25:
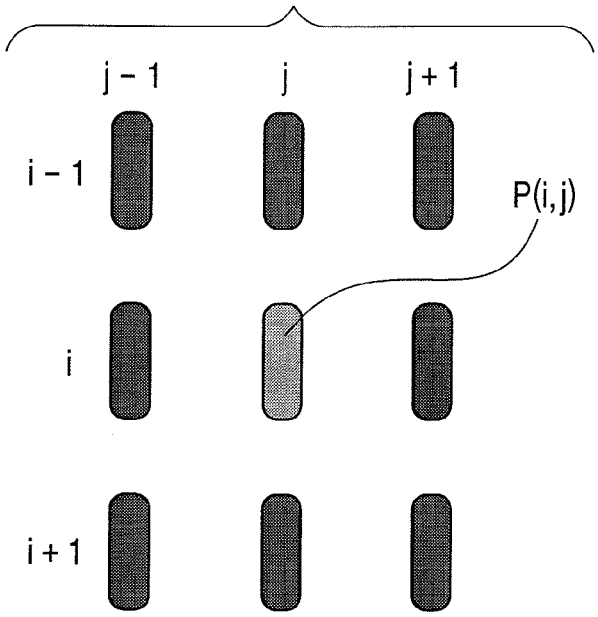
FIG. 25 is a schematic diagram illustrating a pixel structure to specifically explain the effect of the display method of an emission display apparatus according to the embodiment of the present invention.

FIG. 24 illustrates 3×3 pixels. The coordinate in the vertical direction is expressed by "i" and the coordinate in the horizontal direction is expressed by "j". It is assumed that the pixel P(i,j) located at the position (i,j) is turned on for 100 hours using the first display method. The luminance of the pixel P(i,j) before the turning on for 100 hours is represented by 1. The luminance of the pixel P(i,j) after the turning on for 100 hours is represented by $1-\alpha$ in which $\alpha$ ($0<\alpha<1$) indicates a luminance degradation ratio. As illustrated in FIG. 25, when all pixels are allowed to evenly emit light after the pixel P(i,j) being turned on for 100 hours, the luminance L(i,j) of the pixel P(i,j) is $1-\alpha$ and the luminances L(i±1,j) and L(i,j+1) of the surrounding nearby pixels P(i±1,j) and P(i,j+1) is 1. Therefore, when it is assumed that the luminance ratio at which sticking is recognized (sticking recognition luminance ratio) is represented by "x", the conditions under which the sticking is unrecognized when all the pixels emit light can be expressed by Expressions (14) and (15) below. Therefore, in the case where only the first display method is used for display, degradation due to sticking is recognized at the time which the luminance degradation ratio $\alpha$ becomes higher than the sticking recognition luminance ratio "x".

$$\delta=1-(1-\alpha)=\alpha \tag{14}$$

$$\delta\leqq x \tag{15}$$

Figure 26:
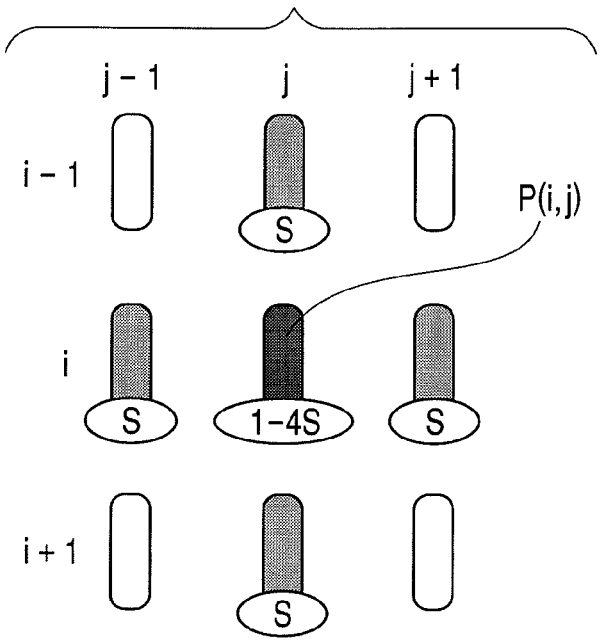
FIG. 26 is a schematic diagram illustrating a pixel structure to specifically explain the effect of the display method of an emission display apparatus according to the embodiment of the present invention.
Figure 27:
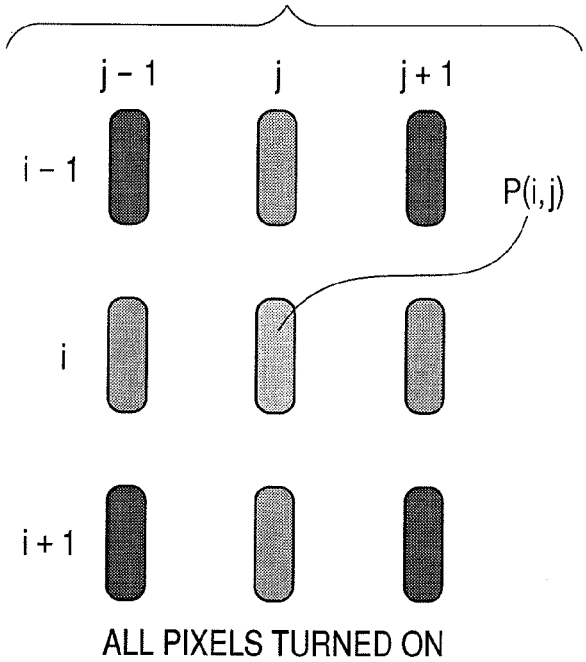
FIG. 27 is a schematic diagram illustrating a pixel structure to specifically explain the effect of the display method of an emission display apparatus according to the embodiment of the present invention.

Here, a case is assumed where the second display method is applied and the pixel P(i,j) is turned on for 100 hours. FIG. 26 illustrates a display mode for the pixel P(i,j) in which the first display method is incorporated at a ratio of 1−4s and the second display method is incorporated at a ratio of 4s. That is, the pixels are turned on for 100 hours in such a display mode that the luminance imposed to the pixel P(i,j) is partly allocated at a ratio of s to each of the nearby pixels P(i+1,j), P(i−1,j), P(i,j+1), and P(i,j−1). A case is assumed where after the pixels are turned on for 100 hours in such a display mode, all the pixels are allowed to evenly emit light as illustrated in FIG. 27. In this case, the luminance L(i,j) of the pixel P(i,j) is $1-\alpha((1-4s)$. Each of the luminances L(i+1,j), L(i−1,j), L(i,j+1), and L(i,j−1) of the nearby pixels P(i+1,j), P(i−1,j), P(i,j+1), and P(i,j−1) is $1-s\alpha$. Each of luminances L(i+1,j+1), L(i+1,j−1), L(i−1,j+1), and L(i−1,j−1) of the pixels P(i+1,j+1), P(i+1,j−1), P(i−1,j+1), and P(i−1,j−1) is 1, Therefore, when it is assumed that the luminance ratio at which sticking is recognized is represented by x, the conditions under which sticking is unrecognized at the time which all the pixels emit light can be expressed by Expressions (16), (17) and (18) below.

$$\delta_1=1-s\alpha-(1-\alpha(1-4s))=\alpha(1-5s) \tag{16}$$

$$\delta_2=1-(1-s\alpha)=s\alpha \tag{17}$$

$$\delta_1\leqq x\ \delta_2\leqq x \tag{18}$$

It can be seen from Expressions (16), (17), and (18) above, the ratio at which the degradation is most difficult to be recognized is obtained when $\delta_1=\delta_2$, that is, s=⅙. Therefore, it can be seen that a display method in which the degradation is most difficult to be recognized at the time of the entire surface emission is one in which the ratio between the first display method and the second display method is 1:2. Further, the luminance degradation ratio $\alpha$ and the sticking recognition luminance ratio x have a relationship expressed by Expression (19) described as follows.

$$\alpha\leqq 6x \tag{19}$$

Therefore, even if the ratio of the second display method is increased, when the luminance degradation ratio $\alpha$ is larger than six times the sticking recognition luminance ratio x, the degradation will be recognized.

Figure 28:
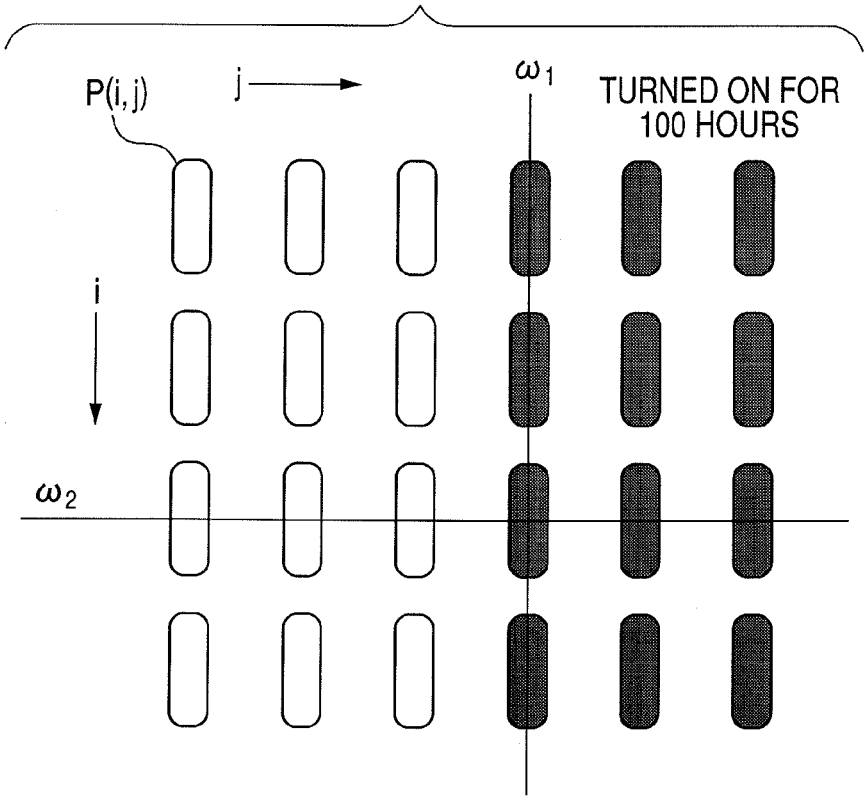
FIG. 28 is a schematic diagram illustrating a pixel structure to specifically explain the effect of the display method of an emission display apparatus according to the embodiment of the present invention.
Figure 29:
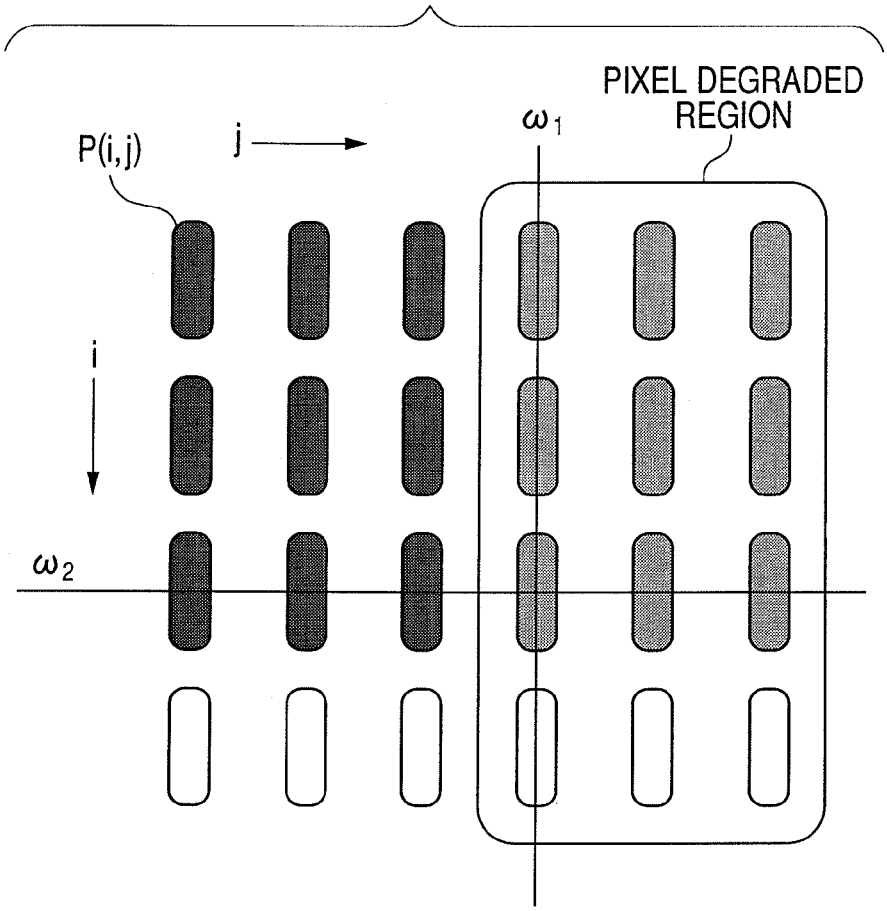
FIG. 29 is a schematic diagram illustrating a pixel structure to specifically explain the effect of the display method of an emission display apparatus according to the embodiment of the present invention.

FIG. 28 illustrates a pixel structure in a case where the coordinate in the vertical direction is expressed by "i", the coordinate in the horizontal direction is expressed by "j", and pixels located at positions $j\geqq\omega_1$ are turned on for 100 hours. The luminance of each of the pixels before the turning on of the pixels for 100 hours is assumed to be 1, and the luminance of the pixel P(i,j) $\{j\geqq\omega_1\}$ after the turning on of the pixels for 100 hours is assumed to be $1-\alpha$. Here, $\alpha$ ($0<\alpha<1$) indicates the luminance degradation ratio. As illustrated in FIG. 29, after the turning on for 100 hours, the pixels of a region $\{i\leqq\omega_2\}$ are allowed to emit light in a display mode in which the first display method is incorporated at a ratio of 1−4s and the second display method is incorporated at a ratio of 4s. That is, the pixel serving as the emission center emits light at a ratio of 1−4s and the current density is allocated (or distributed) at a ratio of s to each of nearby pixels located at upper, lower, right, and left positions. Here, the current density is allocated at a ratio of 1 to pixels of $i<\omega_2$ within the region that emits light, is allocated at a ratio of 1−s to pixels of $i=\omega_2$, and is allocated at a ratio of s to pixels of $i=\omega_2+1$ adjacent to pixels of $i=\omega_2$. Pixels of $i\geqq\omega_2+2$ located outside the pixels of $i=\omega_2+1$, that is, outside the region that emits light are not allowed to emit light.

Therefore, the luminances of the respective pixels are expressed by Expressions (20), (21), (22), (23), (24), and (25) below.

$$L(i,j)\{i=\omega_2+1,j<\omega_1\}=s \tag{20}$$

$$L(i,j)\{i=\omega_2+1,j\geqq\omega\omega_1\}=s(1-\alpha) \tag{21}$$

$$L(i,j)\{i=\omega_2,j<\omega_1\}=1-s \tag{22}$$

$$L(i,j)\{i=\omega_2,j\geqq\omega_1\}=(1-s)(1-\alpha) \tag{23}$$

$$L(i,j)\{i<\omega_2,j<\omega_1\}=1 \tag{24}$$

$$L(i,j)\{i<\omega_2,j\geqq\omega_1\}=1-\alpha \tag{25}$$

Here, the conditions under which sticking is unrecognized between the pixels degraded by the turning on for 100 hours and the other pixels are expressed by Expressions (26), (27), (28), and (29) below. Further, the conditions under which the region that emits light can be seen to be uniform by the application of the second display method are expressed by Expressions (30), (31), and (32) below. According to Expressions (26), (27), (28), and (29), the current density allocation (or distribution) ratio s is 0<s<¼. Therefore, the condition under which sticking is unrecognized between the pixels which are degraded and the pixels which are not degraded is $\alpha \leqq x$. Further, the condition under which the region that emits light can be seen to be uniform by the application of the second display method is $s \leqq x$.

$$\delta_1 = s - s(1-\alpha) = s\alpha \quad (26)$$

$$\delta_2 = 1 - s - (1-s)(1-\alpha) = \alpha(1-s) \quad (27)$$

$$\delta_3 = 1 - (1-\alpha) = \alpha \quad (28)$$

$$\delta_1 \leqq x,\ \delta_2 \leqq x,\ \delta_3 \leqq x \quad (29)$$

$$\delta_4 = 1 - (1-s) = s \quad (30)$$

$$\delta_5 = 1 - \alpha(1-s)(1-\alpha) = s(1-\alpha) \quad (31)$$

$$\delta_4 \leqq x,\ \delta_5 \leqq x \quad (32)$$

As described above, by using the second display method with an optional current density allocation ratio s based on the relationship among the current density allocation ratio s, the luminance degradation ratio $\alpha$, and the sticking recognition luminance ratio x, the degradation due to sticking of an emission display apparatus can be made recognizable with difficulty.

Further, according to the display method of an emission display apparatus of the present invention, switching can be performed among the high-resolution mode with a high ratio of the first display method, the long-life mode with a high ratio of the second display method, and the intermediate mode therebetween.

In the high-resolution mode, a sharp image whose contour is clear can be displayed. However, a load is applied to only a single pixel, so that sticking proceeds. On the other hand, in the long-life mode, the emission luminance of a pixel is distributed to a nearby pixel group surrounding the pixel. Therefore, the current density applied to the pixel is leveled, with the result that the effect of suppressing degradation is obtained. Further, by leveling the emission luminance, the boundary of an outline becomes smooth, with the result that a change due to luminance degradation is prevented from being easily recognized.

Therefore, the long-life mode is applied to display a fixed pattern or the like and is switched to the high-resolution mode only when a natural image or a high-resolution image is to be displayed. Thus, the life of the display panel can be extended.

Further, when the degradation characteristics differ for each emission color, by increasing the ratio of the second display method for an emission color with a rapid progress of degradation, the effect of suppressing color shift can be obtained.

Examples of the other factors involved in luminance degradation of a pixel include emission time, temperature, and maximum emission luminance. When the degree of progress of degradation varies by these factors, by adjusting the combination ratio between the first display method and the second display method such that the degree of progress of degradation is uniform for each emission color, a display panel with a longer life can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-218370, filed Aug. 24, 2007, and Japanese Patent Application No. 2008-189273, filed Jul. 23, 2008 which are hereby incorporated by reference herein in their entirety.

What is claimed is:

1. A display method of an emission display apparatus including a display panel in which a plurality of pixels each having at least one subpixel are disposed, comprising:

when a coordinate in a vertical direction is expressed by "i", and a coordinate in a horizontal direction is expressed by "j", and when display of image input data $D^a(i,j)$ with respect to a subpixel $Sp^a(i,j)$ which constitutes a pixel P(i,j) of the pixels at a position (i,j) and has a display color "a" is performed, and when an emission luminance of the subpixel $Sp^a(i,j)$ is represented by $L^a(i,j)$, a first display method of performing the display of the image input data $D^a(i,j)$ with only the subpixel $Sp^a(i,j)$ using the emission luminance $L^a(i,j)$; and a second display method of performing the display of the image input data $D^a(i,j)$ with a nearby subpixel group $Sp^a(i',j')$, which is a group of subpixels each of which has the display color "a" and is included in a nearby pixel group P(i',j'), which is a group of pixels surrounding the pixel P(i,j), a display according to the second display method being performed with the emission luminance $L^a(i,j)$ distributed to the subpixels of the nearby subpixel group $Sp^a(i',j')$, wherein a display is performed using an intermediate mode in which the first display method and the second display method are combined with a variable combination ratio, wherein in the intermediate mode the emission luminance $L^a(i,j)$ of the subpixel $Sp^a(i,j)$ corresponding the image input data $D^a(i,j)$ is reduced in accordance with the combination ratio, and the display of the image input data $D^a(i,j)$ is performed with the subpixel $Sp^a(i,j)$ using the reduced emission luminance and with the nearby subpixel group $Sp^a(i',j')$ with the emission luminance corresponding to the reduction distributed to the subpixels of the nearby subpixel group $Sp^a(i',j')$, and wherein the combination ratio of the second display method is increased in the intermediate mode with a decrease in image resolution in the image input data $D^a(i,j)$ for the pixel, with a decrease of movement in image in the image input data $D^a(i,j)$ for the pixel, with an increase in an emission time of the image input data $D^a(i,j)$, with an increase in a degradation rate of a subpixel and a reduction in the degradation rate of the subpixel, wherein each of the pixels has at least two subpixels, with a rise in temperature, with an increase in a maximum emission luminance, or with an increase in a display time.

* * * * *